US008670681B2

(12) United States Patent
Hasegawa et al.

(10) Patent No.: US 8,670,681 B2
(45) Date of Patent: Mar. 11, 2014

(54) IMAGE INSPECTION DEVICE AND IMAGE FORMING APPARATUS

(75) Inventors: Shinji Hasegawa, Kanagawa (JP); Yuka Ito, Kanagawa (JP); Suguru Nakaso, Kanagawa (JP); Makoto Furuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 215 days.

(21) Appl. No.: 13/404,600

(22) Filed: Feb. 24, 2012

(65) Prior Publication Data

US 2013/0077982 A1 Mar. 28, 2013

(30) Foreign Application Priority Data

Sep. 28, 2011 (JP) ..... 2011-212409

(51) Int. Cl.
*G03G 15/00* (2006.01)
*G03G 15/20* (2006.01)

(52) U.S. Cl.
USPC ..... 399/15; 399/341

(58) Field of Classification Search
CPC ..... G03G 15/5062
USPC ..... 399/15, 341; 503/201
See application file for complete search history.

(56) References Cited

U.S. PATENT DOCUMENTS 5,394,231 A * 2/1995 Sudo et al. ..... 399/228
5,545,381 A 8/1996 Iida et al.
5,572,311 A * 11/1996 Abe et al. ..... 399/127
5,612,766 A 3/1997 Iida et al.
6,017,386 A * 1/2000 Sano et al. ..... 106/31.32
6,154,243 A * 11/2000 Tatewaki et al. ..... 347/223
RE37,197 E 5/2001 Iida et al.
7,489,415 B2 * 2/2009 Furuta et al. ..... 358/1.15
7,490,779 B2 * 2/2009 Shinozaki ..... 235/472.03
2003/0104938 A1 * 6/2003 Torii et al. ..... 503/201
2005/0014645 A1 * 1/2005 Shimbo et al. ..... 503/201
2005/0176582 A1 * 8/2005 Arai et al. ..... 503/201
2005/0191082 A1 * 9/2005 Takayama et al. ..... 399/101
2007/0231724 A1 * 10/2007 Kimura et al. ..... 430/108.1
2008/0012288 A1 * 1/2008 Fischer ..... 283/94
2010/0069239 A1 * 3/2010 Asai et al. ..... 503/201
2011/0074086 A1 * 3/2011 Iguchi et al. ..... 271/3.18
2011/0090268 A1 * 4/2011 Xu ..... 347/6
2011/0222130 A1 * 9/2011 Iguchi et al. ..... 358/452

FOREIGN PATENT DOCUMENTS

JP 04-356087 12/1992
JP 08-101612 4/1996
JP 2011-017996 1/2011

* cited by examiner

*Primary Examiner* — G. M. Hyder
(74) *Attorney, Agent, or Firm* — Oliff PLC

(57) ABSTRACT

An image inspection device includes an acquiring section that reads an image formed on an image carrying medium using an image forming material and acquires first inspection image information; and a decoloring section that leaves an infrared absorbent on the image carrying medium, and decolors a decolorable composition on the image carrying medium by physical treatment or chemical treatment, wherein the image forming material contains the infrared absorbent having an optical absorption peak in an infrared region, and the image forming material contains the decolorable composition having an optical absorption peak in a visible region in a color-developed state and being decolored by physical treatment or chemical treatment.

18 Claims, 10 Drawing Sheets

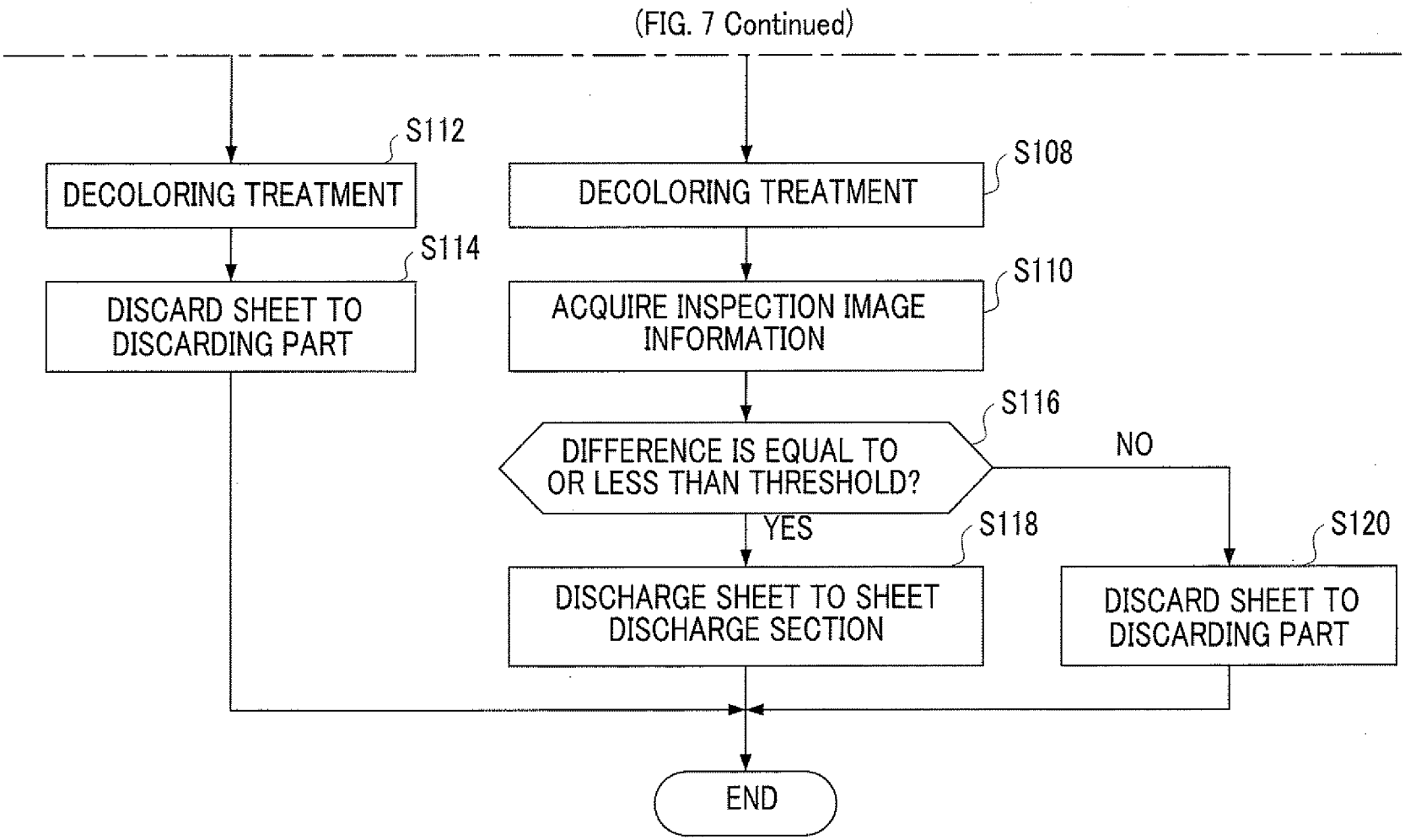
(FIG. 7 Continued)
S108
DECOLORING TREATMENT
S110
ACQUIRE INSPECTION IMAGE INFORMATION
S116
DIFFERENCE IS EQUAL TO OR LESS THAN THRESHOLD?
NO
YES
S118
DISCHARGE SHEET TO SHEET DISCHARGE SECTION
S120
DISCARD SHEET TO DISCARDING PART
S112
DECOLORING TREATMENT
S114
DISCARD SHEET TO DISCARDING PART
END

IMAGE INSPECTION DEVICE AND IMAGE FORMING APPARATUS

CROSS-REFERENCE TO RELATED APPLICATIONS

This application is based on and claims priority under 35 USC 119 from Japanese Patent Application No. 2011-212409 filed Sep. 28, 2011.

BACKGROUND

Technical Field

The present invention relates to an image inspection device and an image forming apparatus.

SUMMARY

According to an aspect of the invention, there is provided an image inspection device including: an acquiring section that reads an image formed on an image carrying medium using an image forming material and acquires first inspection image information; and decoloring section that leaves an infrared absorbent on the image carrying medium, and decolors a decolorable composition on the image carrying medium by physical treatment or chemical treatment, wherein the image forming material contains the infrared absorbent having an optical absorption peak in an infrared region, and the image forming material contains the decolorable composition having an optical absorption peak in a visible region in a color-developed state and being decolored by physical treatment or chemical treatment.

BRIEF DESCRIPTION OF THE DRAWINGS

Exemplary embodiments of the present invention will be described in detail based on the following figures, wherein.

DETAILED DESCRIPTION

Figure 1A:
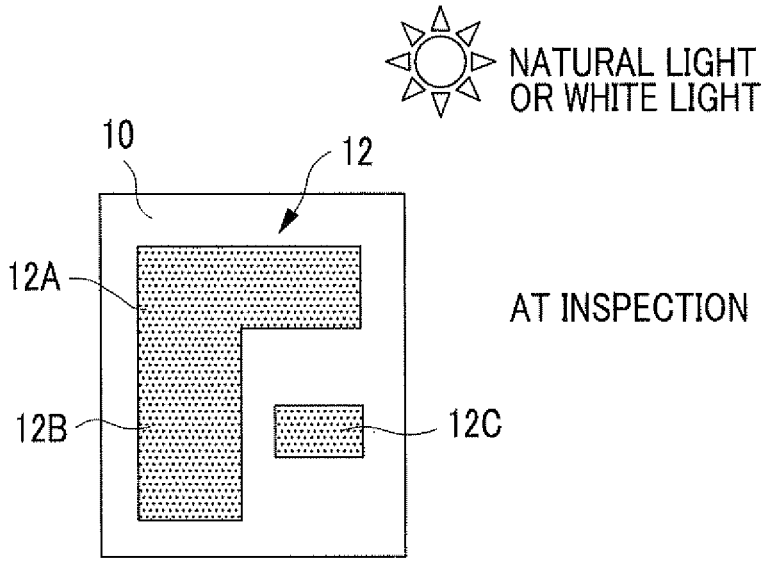
FIG. 1A is a schematic view showing an image carrying medium having a latent image and a visible image superimposed and formed thereon.

Hereinafter, an example of an exemplary embodiment of the invention will be described in detail with reference to the drawings.

<Image Carrying Medium>

First, an image carrying medium related to the present exemplary embodiment will be described.

The image carrying medium related to the present exemplary embodiment carries a superimposed image having a visible image and a latent image superimposed on the medium at image inspection. In other words, the superimposed image is the same image as the latent image except being visible. Here, the "latent image" is an image that is difficult to be visually recognized with naked eyes under the natural light or white light compared to an image created using ordinary image forming materials (individual CMYK color toners or the like) and that is read by radiating infrared rays and detecting the reflected infrared rays.

In the present exemplary embodiment, the superimposed image carried on the medium is read as a visible image at image inspection. The superimposed image is decolored into a latent image after the image inspection. Accordingly, the image carrying medium related to the present exemplary embodiment carries the latent image on the medium after the decoloring treatment. An image forming material containing an infrared absorbent having an optical absorption peak in an infrared region, and a decolorable composition having an optical absorption peak in a visible region in a color-developed state and decolored by physical treatment or chemical treatment is used for the formation of a superimposed image that exhibits this discoloration function. In addition, the details of the image forming material related to the present exemplary embodiment will be described below.

The image carrying medium is a medium that has an image formed from an image forming material thereon and carries the formed image. In order to form the latent image that is difficult to be visually recognized with naked eyes, an image carrying medium may be selected according to image forming materials such as setting a color difference $\Delta E$ between the latent image and the image carrying medium to less than 6. Otherwise, the image forming material may be adjusted according to the image carrying medium. Generally, sheet-shaped paper media such as white sheet and recycled sheet, and sheet-shaped resin media such as a polymer film, are used as the image carrying medium. The color difference $\Delta E$ is a color difference expressed using individual values of $L^*$, $a^*$, and $b^*$ in the CIE1976 $L^*a^*b^*$ color system.

The latent image may be arbitrary types of images such as characters, signs, or figures. The latent image may include coded information, such one-dimensional codes such as bar codes, two-dimensional codes expressed by plural pixels (dots) such as QR codes or glyph codes, or the like. The coded information is decoded by reading the latent image. For example, positional information showing the positional coordinates of individual signs, identification information that identifies the image carrying medium, or the like may be coded, or may be embedded in the latent image. Additionally, the latent image may be carried at arbitrary positions of the image carrying medium such as one surface or both surfaces of the image carrying medium or all the regions or some regions in a plan view. For example, plural two-dimensional codes showing predetermined information may be provided in all the regions of one side of the image carrying medium.

Figure 1B:
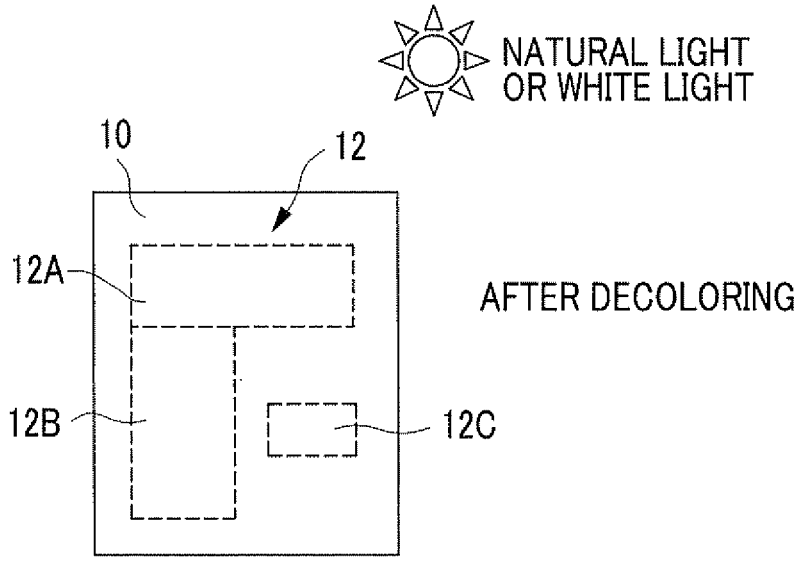
FIG. 1B is a schematic view showing that the visible image is decolored.
Figure 1C:
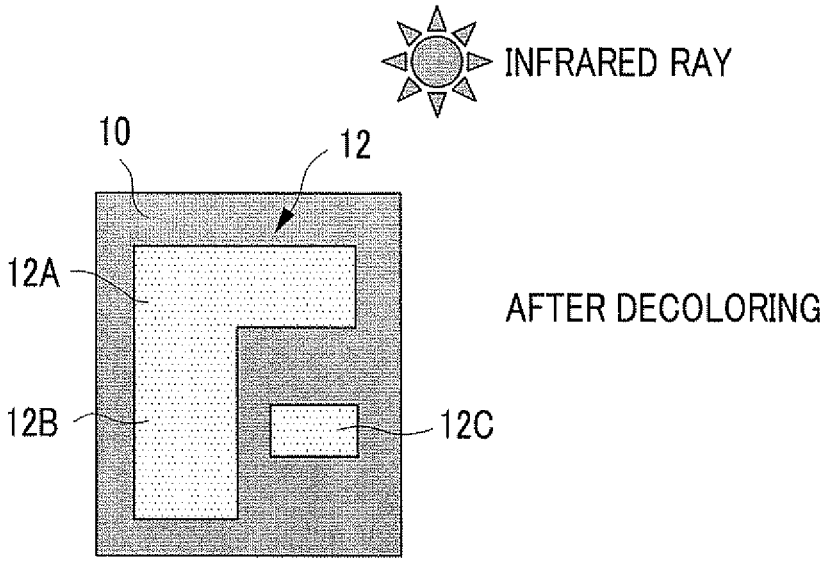
FIG. 1C is a schematic view showing that the latent image is read by being irradiated with infrared rays.

FIGS. 1A to 1C are schematic views showing an example of an image carrying medium carrying a latent image or a superimposed image. The image forming material related to the present exemplary embodiment includes a decolorable composition having an optical absorption peak in a visible region in a color-developed state, and the decolorable composition is in a color-developed state when an image is formed. That is, a visible image is formed using a decolorable composition. Additionally, the image forming material related to the present exemplary embodiment includes an infrared absorbent having an optical absorption peak in an infrared region, and a latent image is formed so as to be superimposed on a visible image using the infrared absorbent.

As described above, the latent image may not be visually recognized with naked eyes under the natural light or white light. In the present exemplary embodiment, a superimposed image 12 of which a visible image and a latent image are superimposed on each other is formed on an image carrying medium 10 at image inspection. The superimposed image 12 is a visible image and is visually recognized with naked eyes under the natural light or white light. Additionally, the superimposed image 12 is read as a visible image by an ordinary image reader that reads the visible image.

In the example shown in FIG. 1, the superimposed image 12 is constituted by a first region 12A, a second region 12B, and a third region 120. Additionally, a latent image corresponding to the superimposed image 12 is an image in which plural two-dimensional codes are arrayed. Positional information showing the positional coordinates of respective signs and identification information that identifies the image carrying medium 10 are embedded in the latent image. Different kinds of information may be embedded in the first region 12A, the second region 12B, and the third region 12C, respectively.

The above decolorable composition is decolored by physical treatment or chemical treatment. In the present exemplary embodiment, the decolorable composition is decolored by physical or chemical decoloring treatment after image inspection is ended. On the other hand, the infrared absorbent is not affected by the decoloring treatment. Accordingly, as shown in FIG. 1B, the visible image that constitutes the superimposed image 12 is decolored, and the latent image that constitutes the superimposed image is left behind. The superimposed image is decolored into a latent image by the decoloring treatment, and the latent image may not be visually recognized with naked eyes under the natural light or white light.

As shown in FIG. 10, the latent image left behind on the image carrying medium 10 is read by radiating infrared rays and detecting the reflected infrared rays. If infrared rays are irradiated to the image carrying medium 10, the infrared rays are absorbed by the infrared absorbent, and the infrared rays that are not absorbed are reflected. In an ordinary image reader that reads a visible image, the infrared rays are not detected and a latent image may not be read. If an image reader only for infrared rays, such as an infrared camera or an infrared image sensor, is not used, it is not possible to read a latent image.

If a visible image (solid images such as ▲ mark) showing the position of a latent image is formed in order to perform image inspection, the function of the latent image that may not be visually recognized with naked eyes is impaired, and use applications are limited. In the present exemplary embodiment, since the superimposed image 12 is read as a visible image at image inspection, it is not necessary to separately form the visible image showing the position of a latent image.

<Image Forming Material>

Next, the image forming material related to the present exemplary embodiment will be described.

The image forming material related to the present exemplary embodiment is a material containing an infrared absorbent having an optical absorption peak in an infrared region, and a decolorable composition having an optical absorption peak in a visible region in a color-developed state and decolored by physical treatment or chemical treatment, and forms the superimposed image on an image carrying medium. As the image forming method, methods well-known in the art such as electrophotography, ink jet printing, letterpress printing, offset printing, flexographic printing, gravure, and silk printing may be used. Accordingly, the image forming material related to the present exemplary embodiment is used in various forms such as an electrophotographic developer and various kinds of printing ink, according to the image forming method. Additionally, writing ink may be used.

(Infrared Absorbent)

The infrared absorbent may be those having an optical absorption peak in an infrared region from a wavelength of 780 nm to a wavelength of 1000 nm. As the infrared absorbent, there may be used infrared absorbents well-known in the art such as cyanine compounds, merocyanine compounds, benzene thiol-based metal complexes, mercaptophenol-based metal complexes, aromatic diamine-based metal complexes, diimmonium compounds, aminium compounds, nickel complex compounds, phthalocyanine compounds, anthraquinone compounds, naphthalocyanine compounds, and the like.

As the infrared absorbent, for example, an organic or inorganic near-infrared absorbent may be used. Examples of the organic near-infrared absorbent include diimmonium-based dyes, phthalocyanine-based dyes, dithiol metal complex-based dyes, substituted benzendithiol metal complex-based dyes, cyanine-based dyes, squarylium-based dyes, and the like. Examples of the inorganic near-infrared absorbent include ATO (antimony-doped tin oxide), ITO (tin-doped indium oxide), and the like.

Examples the squarylium dyes include perimidine quarylium dyes expressed by the following structural formula (I).

[Chemical Formula 1]

(I)

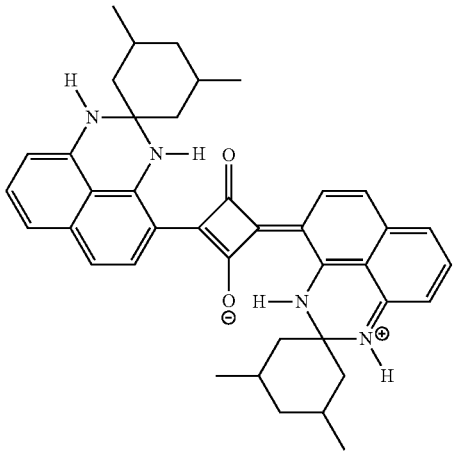

The perimidine squarylium dyes expressed by Structural Formula (I) have high light resistance compared to dyes used for other latent images such as naphthaalocyanine materials. This is because the perimidine squarylium dyes expressed by Structural Formula (1) have high crystallinity and low solubility to resin. For this reason, it is believed that cleaving of the coupling in the molecules is suppressed by absorbing light energy by the irradiation of light.

The perimidine squarylium dyes expressed by Structural Formula (I) have high crystallinity. Specifically, examples of the dyes include dyes in which the Bragg angle) (2θ±0.2°) in a powder X-ray diffraction spectrum measured by irradiation of X-rays with a wavelength of 1.5405 Å to a Cu target shows diffraction peaks at least at 9.9°, 13.2°, 19.9°, 20.8°, and 23.0°, dyes in which the Bragg angle show diffraction peaks at least 17.7°, 19.9°, 22.1°, 23.2°, and 24.9°, and dyes in which the Bragg angle shows diffraction peaks at least at 8.9°, 17.1°, 18.4°, 22.6°, and 24.2°, and the like. Among these, the above dyes showing diffraction peaks at 17.7°, 19.9°, 22.1°, 23.2°, and 24.9° are desirable from a viewpoint of light resistance.

In addition, the perimidine squarylium dyes expressed by Structural Formula (I) have sufficiently low light adsorption capacity in a visible light wavelength region of 400 nm or more and 750 nm or less, and have sufficiently high light adsorption capacity in a near-infrared light wavelength region of 750 nm or more and 1000 nm or less.

The "sufficiently low light adsorption capacity" shows that the molar light adsorption coefficient of a solution in a visible light wavelength region of 400 nm or more and 450 nm or less is at least equal to or less than 8100 $M^{-1}$ $cm^{-1}$, the molar light adsorption coefficient of the solution in a visible light wavelength region of 450 nm or more and 650 nm or less is at least equal to or less than 3400 $M^{-1}cm^{-1}$, the molar light adsorption coefficient of the solution in a visible light wavelength region of 650 nm or more and 690 nm or less is at least equal to or less than 8800 $M^{-1}cm^{-1}$, and the molar light adsorption coefficient of the solution in a visible light wavelength region of 690 nm or more and 750 nm or less is at least equal to or less than 37000 $M^{-1}cm^{-1}$.

Additionally, the "sufficiently high light adsorption capacity" shows that the local maximum value of the molar light adsorption coefficient of the solution in the whole region of a near-infrared light wavelength region of 750 nm or more and 1000 nm or less is at least equal to or more than $1.5\times10^5$ $M^{-1}cm^{-1}$.

For this reason, a latent image formed from an image forming material containing a perimidine squarylium dye expressed by Structural Formula (I) have easy compatibility between non-visibility and infrared readability according to visible light.

The perimidine squarylium dyes expressed by Structural Formula (1) are obtained, for example according to the following reaction scheme.

[Chemical Formula 2]

(A-1)

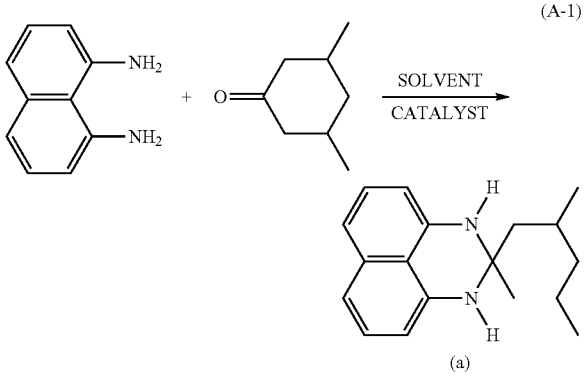

-continued (A-2)

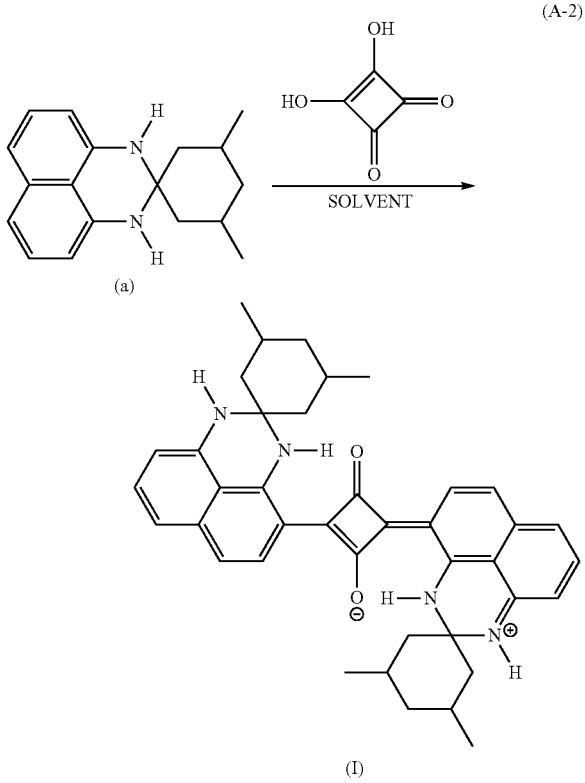

More specifically, a perimidine intermediate (a) is obtained by making 1,8-diaminonaphthalene react with 3,5-dimethylcyclohexanone on the condition of azeotrope reflux in a solvent in the presence of a catalyst (Process (A-1)).

Examples of the catalyst to be used in Process (A-1) include p-toluenesulfonic acid monohydrate, benzenesulfonic acid monohydrate, 4-chlorobenzene sulfonic acid hydrate, pyridine-3-sulfonic acid, ethane sulfonic acid, sulfuric acid, nitric acid, acetic acid, and the like. Additionally, examples of the solvent to be used in Process (A-1) include alcohols, aromatic hydrocarbons, and the like. The perimidine intermediate (a) is refined by high-speed column chromatography or recrystallization.

Next, the perimidine squarylium dyes expressed by Structural Formula (I) are obtained by making the perimidine intermediate (a) react with 3,4-dihydroxycyclobut-3-ene-1,2-dione (referred to as "squaric acid" or "quadratic acid") on the condition of azeotrope reflux in a solvent (Process) (A-2). Process (A-2) may be performed in a nitrogen gas atmosphere.

As the solvent used for Process (A-2), alcohols such as 1-propanol, 1-butanol, and 1-pentanol; aromatic hydrocarbons such as benzene, toluene, xylene, and monochlorobenzene; ethers such as tetrahydrofuran and dioxane; halogenated hydrocarbons such as chloroform, dichloroethane, trichloroethane, and dichloropropanel; and amides such as N,N-dimethylformamide and N,N-dimethylacetamide, are used. Additionally, although the alcohols may be used singly, solvents such as aromatic hydrocarbons, ethers, halogenated hydrocarbons, or amides, may be used by mixing an alcohol solvent.

Specifically, examples of the solvent include 1-propanol, 2-propanol, 1-butanol, 2-butanol, a mixed solvent of 1-propanol and benzene, a mixed solvent of 1-propanol and toluene, a mixed solvent of 1-propanol and N,N-dimethylformamide, a mixed solvent of 2-propanol and benzene, a mixed solvent of 2-propanol and toluene, a mixed solvent of 2-propanol and N,N-dimethylformamide, a mixed solvent of 1-butanol and benzene, a mixed solvent of 1-butanol and toluene, a mixed solvent of 1-butanol and N,N-dimethylformamide, a mixed solvent of 2-butanol and benzene, a mixed solvent of 2-butanol and toluene, and a mixed solvent of 2-butanol and N,N-dimethylformamide. When the mixed solvents are used, the concentration of an alcohol solvent may be 1 vol. % or more or 5 vol. % or more and 75 vol. % or less.

Additionally, in Process (A-2), the example of the molar ratio (the molar number of a perimidine derivative (a)/the molar number of 3,4-dihydroxycyclobut-3-ene-1,2-dione) of the perimidine derivative (a) to 3,4-dihydroxycyclobut-3-ene-1,2-dione includes 1 or more and 4 or less or 1,5 or more and 3 or less. When the molar ratio is less than 1, the yield of the perimidine squarylium dyes expressed by Structural Formula (I) may decline. Additionally, when the molar ratio exceeds 4, the utilization efficiency of the perimidine derivative (a) may be reduced, and separation or refinement of the perimidine squarylium dyes expressed by Structural Formula (I) may become difficult.

Moreover, if a dehydrating agent is used in Process (A-2), reaction time tends to be shortened, and the yield of the perimidine squarylium dyes expressed by Structural Formula (I) tends to be improved. The dehydrating agent are not particularly limited if those that do not react with the perimidine intermediate (a) and 3,4-dihydroxy cyclobut-3-ene-1,2-dione are used, and examples thereof include orthoformic acid esters such as orthoformic acid trimethyl, orthoformic acid triethyl, orthoformic acid tripropyl, and orthoformic acid tributyl, molecular sieves, and the like.

Although the reaction temperature in Process (A-2) varies according to the type of a solvent to be used, the temperature of a reaction liquid is equal to or higher than 60° C. or equal to or higher than 75° C. For example, when a mixed solvent of 1-butanol and toluene is used, the temperature of reaction liquid is 75° C. or higher and 105° C. or lower.

Additionally, although the reaction time in Process (A-2) varies according to the type of a solvent or the temperature of a reaction liquid, for example, when a reaction is caused using the mixed solvent of 1-butanol and toluene with the temperature of the reaction liquid being 90° C. or higher and 105° C. or lower, the reaction time is between 2 hours and 4 hours.

The perimidine squarylium dyes expressed by Structural Formula (I) generated in Process (A-2) are refined by solvent cleaning, high-speed column chromatography, or recrystallization.

Additionally, although the perimidine squarylium dyes expressed by Structural Formula (I) may be subjected to pigmentation treatment, if the pigmentation treatment is performed, it is believed that a crystal system changes easily. Therefore, the method and processing conditions of the pigmentation treatment may be adjusted so that conversion of a crystal system of perimidine squarylium dye particles (raw material) before the pigmentation treatment may be suppressed. That is, the method and processing conditions may be adjusted so as to show the X-ray diffraction peak of the perimidine squarylium dye particles. Specifically, since the perimidine squarylium dyes may be dyes in which the Bragg angle) (2θ±0.2°) in a powder X-ray diffraction spectrum measured by irradiation of X-rays with a wavelength of 1.5405 Å to a Cu target shows diffraction peaks at least at 17.7°, 19.9°, 22.1°, 23.2°, and 24.9°, it is favorable from a viewpoint of an improvement in light resistance that the perimidine squarylium dyes after pigmentation treatment are adjusted so as to show the diffraction peaks.

An example of the pigmenting method includes a method of mixing a perimidine squarylium dye expressed by Structural Formula (I) with a sodium dodecylbenzenesulfonate water solution, and performing pigmentation treatment on the mixed solution. The concentration of the mixed-solution may be regulated by adding water thereto if needed. Additionally, an example of an apparatus to be used for pigmentation treatment includes a bead mill processing apparatus.

The perimidine squarylium dyes expressed by Structural Formula (I) may be contained as particles. The perimidine squarylium dyes expressed by Structural Formula (I) have a large interaction between molecules, and the particles thereof have high crystallinity. For this reason, it is believed that infrared absorption capacity and light resistance are further enhanced by causing a particulate perimidine squarylium dye expressed by Structural Formula (I) to be contained in an image forming material.

The particles of the perimidine squarylium dyes expressed by Structural Formula (I) are obtained, for example, by melting a refined substance after Process (A-2) in tetrahydrofuran, pouring the solution into distilled water cooled with ice using an injector or the like while being stirred, thereby generating precipitate, filtering the precipitate by suction filtration, washing with the distilled water, and then performing vacuum drying. At this time, the particle diameter of the obtained precipitate is adjusted by adjusting the concentration of the perimidine squarylium dyes expressed by Structural Formula (I) in the solution, the pouring rate of the solution, the amount or temperature of the distilled water, stirring speed, or the like.

Examples of the median size d50 of the particles of the perimidine squarylium dyes expressed by Structural Formula (I) include 10 nm or more and 300 nm or less or 20 nm or more and 200 nm or less. If the median size d50 of the particles of the perimidine squarylium dyes expressed by Structural Formula (I) is within the above range, it is believed that degradation of light resistance is suppressed, and infrared absorption capacity is improved.

In addition, the infrared absorbent may be used singly or may be used in combinations of two or more thereof.

In the present exemplary embodiment, the phthalocyanine dyes and the perimidine squarylium dyes may be used as the infrared absorbent. These dyes have the advantage of not easily degrading in a decoloring treatment in which they are heated or made to come into contact with an organic solvent. In the phthalocyanine dyes, the naphthalocyanine dyes are not easily deteriorated in the above decoloring treatment, which is particularly preferable.

It is desirable from a viewpoint of the image detection sensitivity during image reading that the content of the infrared absorbent be 0.1 parts by mass or more and 20 parts by mass or less with respect to 100 parts by mass of an image forming material.

(Decolorable Composition)

The decolorable composition may be a composition having an optical absorption peak in a visible region in a color-developed state and decolored by physical treatment or chemical treatment. Here, the "visible region" is a wavelength band from the wavelength of 380 nm to the wavelength of 780 nm. Examples of the physical treatment or chemical treatment include heating, light irradiation, and contact with an organic solvent. The "color-developed state" means a state where visual recognition may be made with naked eyes under the natural light or white light. The "decoloring" means shifting to a state where visual recognition may not be made with naked eyes under the natural light or white light from the "color-developed state".

As the above decolorable composition, it may use (1) a first composition containing a colorable compound having an electron-donative group and a developer having an electron-receptive group, and (2) a second composition containing a colorable compound having an electron-donative group, a developer having an electron-receptive group, and a decoloring agent having an electron-donative group. It is presumed that the first composition and second composition have the same color developing mechanism, but have different decoloring mechanisms. For example, when certain conditions are satisfied such that heating to a color-developing temperature or higher is made at the time of color development, the electronic interaction between a colorable compound and a developer increases, and a color-developed state is brought about.

In the first composition, for example, when certain conditions are satisfied such that heating to a decoloring temperature or higher that is higher than the color-developing temperature is made at the time of decoloring, the electronic interaction between a colorable compound and a developer decreases, and a decolored state is brought about. In this case, the color development and the decoloring become irreversible within a predetermined temperature range, for example, by increasing a temperature difference between the decoloring temperature and the color-developing temperature or adding a hysteresis temperature control agent.

In contrast, in the second composition, for example, when certain conditions are satisfied such that heating to a decoloring temperature or higher that is higher than the color-developing temperature is made at the time of decoloring, the electronic interaction between a developer and a decoloring agent increases than the electronic interaction between a colorable compound and a developer, and a decolored state is brought about as the developer is separated from the colorable compound.

(First Composition)

The "first composition" containing a colorable compound having an electron-donative group and a developer having an electron-receptive group will be described.

—Colorable Compound—

The so-called "leuco dye" is used as the colorable compound that constitutes the first composition. Examples of leuco dye include triphenyl methane phthalide compounds, fluoran compounds, phenothiazine compounds, indolyl phthalide compounds, leucoauramine compounds, rhodamine lactam compounds, triphenyl methane compounds, triazene compounds, spiropyran compounds, fluorene compounds, and the like.

Specific examples of the phthalide compounds are described in U.S. Reissued Pat. No. 23,024 and U.S. Pat. Nos. 3,491,111, 3,491,112, 3,491,116, and 3,509,174; specific examples of the fluoran compounds are described in U.S. Pat. Nos. 3,624,107, 3,627,787, 3,641,011, 3,462,828, 3,681,390, 3,920,510, and 3,959,571; specific examples of the spirodipyran compounds are described in U.S. Pat. No. 3,971,808; specific examples of the pyridine and pyrazine compounds are described in U.S. Pat. Nos. 3,775,424, 3,853,869, and 4,246,318; and specific examples of the fluorene compounds are described in JP-A-63-94878 or the like.

If these specific examples are disclosed, Specific examples of the triaryl methane compounds include 3,3-bis(p-dimethylaminophenyl)-6-dimethylaminophthalide, 3,3-bis(p-dimethylaminophenyl)phthalide, 3-(p-dimethylaminophenyl)-3-(1,3-dimethylindol-3-yl)phthalide, 3-(p-dimethylaminophenyl)-3-(2-methylindol-3-yl)phthalide, and the like.

Additionally, specific examples of the diphenylmethane compounds include 4,4'-bis-dimethylaminobenzhydrynbenzyl ether, N-halophenylleucoauramine, N-2,4,5-trichlorophenylleucoauramine, and the like.

Additionally, specific examples of the xanthene compounds include rhodamine-B-anilinolactam, rhodamine-(p-nitroanilino)lactam, 2-(dibenzylamino)fluoran, 2-anilino-3-methyl-6-diethylaminofluoran, 2-anilino-3-methyl-6-dibutylaminofluoran, 2-anilino-3-methyl-6-N-ethyl-N-isoamylaminofluoran, 2-anilino-3-methyl-6-N-methyl-N-cyclohexylaminofluoran, 2-anilino-3-chlor-6-diethylaminofluoran, 2-anilino-3-methyl-6-N-ethyl-N-isobutylaminofluoran, 2-anilino-6-dibutylaminofluoran, 2-anilino-3-methyl-6-N-methyl-N-tetrahydrofurfurylaminofluoran, 2-anilino-3-methyl-6-piperidinoaminofluoran, 2-(o-chloroanilino)-6-diethylaminofluoran, 2-(3,4-dichloranilino)-6-diethylaminofluoran, and the like.

Specific examples of the thiazine compounds include benzoyl leucomethylene blue, p-nitrobenzyl leucomethylene blue, and the like. Specific examples of the spirodipyran compounds include 3-methyl-spiro-dinaphthopyran, 3-ethyl-spiro-dinaphthopyran, 3,3'-di chloro-spiro-dinaphthopyran, 3-benzyl-spiro-dinaphthopyran, 3-methyl-naphtho-(3-methoxy-benzo)-spiropyran, 3-propyl-spiro-dibenzopyran, and the like.

The leuco dye may be used singly or may be used in a mixture of two or more thereof. The additive amount of the leuco dye is 0.5 parts by mass or more and 20 parts by mass or less, and preferably 2 parts by mass or more and parts by mass or less, with respect to 100 parts by mass of the binder resin.

—Developer—

Examples of the developer that constitutes the developer-first composition include phenol derivatives, sulfur-containing phenol derivatives, organic carboxylic acid derivates (for example, salicylic acid, stearic acid, resorcinol acid, and the like) and metal salts thereof or the like, sulfonic acid derivatives, urea or thio urea derivatives or the like, acid clay, bentonite, novolak resin, metal-treated novolak resin, and metal complexes.

These examples are described in Japanese Patent Application Publication Nos. 40-9309 and 45-14039, JP-A-52-140483, JP-A-48-51510, JP-A-57-210886, JP-A-58-87089, JP-A59-11286, JP-A-60-176795, JP-A-61-95988, or the like, in addition to the descriptions on pp. 49 to 54 and pp. 65 to 70 from Pulp and Paper Industry Times (1985).

Specific examples thereof include phenols such as p-(dodecylthio)phenol, p-(tetradecylthio)phenol, p-(hexadecylthio)phenol, p-(octadecylthio)phenol, p-(eicosylthio)phenol, p-(docosylthio)phenol, p-(tetracosylthio)phenol, p-(dodecyloxy)phenol, p-(tetradecyloxy)phenol, p-(hexadecyloxy)phenol, p-(octadecyloxy)phenol, p-(eicosyloxy)phenol, p-(docosyloxy)phenol, p-(tetracosyloxy)phenol, p-dodecylcarbamoylphenol, p-tetradecylcarbamoylphenol, p-hexadecylcarbamoylphenol, p-octadecylcarbamoylphenol, p-eicosylcarbamoylphenol, p-docosylcarbamoylphenol, p-tetracosylcarbamoylphenol, hexadecyl gallate, octadecyl gallate, eicosyl gallate, docosyl gallate, or tetracosyl gallate, and phenol metal salts;

carboxylic acids such as α-hydroxydodecanoic acid, α-hydroxytetradecanoic acid, α-hydroxyhexadecanoic acid, α-hydroxyoctadecanoic acid, α-hydroxypentadecanoic acid, α-hydroxyeicosanoic acid, α-hydroxydocosanoic acid, α-hydroxytetracosanoic acid, α-hydroxyhexacosanoic acid, α-hydroxyoctacosanoic acid, 2-chlorooctadecanoic acid, heptadecafluorononadecanoic acid, 2-bromohexadecanoic acid, 2-bromoheptadecanoic acid, 2-bromooctadecanoic acid, 2-bromoeicosanoic acid, 2-bromodocosanoic acid, 2-bromotetracosanoic acid, 3-bromooctadecanoic acid, 3-bromoeicosanoic acid, 2,3-dibromooctadecanoic acid, 2-fluorododecanoic acid, 2-fluorotetradecanoic acid, 2-fluorohexadecanoic acid, 2-fluorooctadecanoic acid, 2-fluoroeicosanoic acid, 2-fluorodocosanoic acid, 2-iodohexadecanoic acid, 2-iodooctadecanoic acid, 3-iodohexadecanoic acid, 3-iodooctadecanoic acid, perfluorooctadecanoic acid, 2-oxododecanoic acid, 2-oxotetradecanoic acid, 2-oxohexadecanoic acid, 2-oxooctadecanoic acid, 2-oxoeicosanoic acid, 2-oxotetracosanoic acid, 3-oxododecanoic acid, 3-oxotetradodecanoic acid, 3-oxohexadecanoic acid, 3-oxooctadeoanoic acid, 3-oxoeicosanoic acid, 3-oxotetracosanoic acid, 4-oxohexadecanoic acid, 4-oxoheptadecanoic acid, 4-oxooctadecanoic acid, 4-oxodocosanoic acid, dodecylmalic acid, tetradecylmalic acid, hexadecylmalic acid, octadecylmalic acid, eicosylmalic acid, docosylmalic acid, tetracosylmalic acid, dodecylthiomalic acid, tetradecylthiomalic acid, hexadecylthiomalic acid, octadecylthiomalic acid, eicosylthiomalic acid, docosylthiomalic acid, tetracosylthiomalic acid, dodecyldithiomalic acid, tetradecyldithiomalic acid, hexadecyldithiomalic acid, octadecyldithiomalic acid, eicosyldithiomalic acid, docosyidithiomalic acid, tetracosyldithiomalic acid;

dodecylbutanedioic acid, tridecylbutanedioic acid, tetradecylbutanedioic acid, pentadecylbutanedioic acid, octadecylbutanedioic acid, eicosylbutanedioic acid, docosylbutanedioic acid, 2,3-dihexadecylbutanedioic acid, 2,3-dioctadecylbutanedioic acid, 2-methyl-3-dodecylbutanedioic acid, 2-methyl-3-tetradecylbutanedioic acid, 2-methyl-3-hexadecylbutanedioic acid, 2-ethyl-3-dodecylbutanedioic acid, 2-propyl-3-decylbutanedioic acid, 2-octyl-3-hexadecylbutanedioic acid, 2-tetradecyl-3-octadecylbutanedioic acid, dodecylmalonic acid, tetradecylmalonic acid, hexadecylmalonic acid, octadecylmalonic acid, eicosylmalonic acid, docosylmalonic acid, tetracosylmalonic acid, didodecylmalonic acid, ditetradecylmalonic acid, dihexadecylmalonic acid, dioctadecylmalonic acid, dieicosylmalonic acid, didocosylmalonic acid, methyloctadecylmalonic acid, methyleicosylmalonic acid, methyldocosylmalonic acid, methyltetracosylmalonic acid, ethyloctadecylmalonic acid, ethyleicosylmalonic acid, ethyldocosylmalonic acid, ethyltetracosylmalonic acid, 2-dodecyl-pentanedioic acid, 2-hexadecyl-pentanedioic acid, 2-octadecyl-pentanedioic acid, 2-eicosyl-pentanedioic acid, 2-docosyl-pentanedioic acid, 2-dodecyl-hexanedioic acid, 2-pertadecyl-hexanedioic acid, 2-octadecyl-hexanedioic acid, 2-eicosyl-hexanedioic acid, or 2-docosyl-hexanedioic acid, and carboxylic acid metal salts;

Organic phosphoric acid compounds such as dodecylphosphonic acid, tetradecylphosphonic acid, hexadecylphosphonic acid, octadecylphosphonic acid, eicosylphosphonic acid, docosylphosphonic acid, tetracosylphosphonic acid, hexacosylphosphonic acid, or octacosylphosphonic acid; and acidic materials such as benzophenone, sulfonic acid, or sulfonates. Particularly, compounds excellent in crystallinity may be desirably used.

These compounds may be used singly or may be used in a mixture of two or more thereof depending on the case. The additive amount of the developer is preferably 0.4 parts by mass or more and 5 parts by mass or less, more preferably 0.5 parts by mass or more and 4.0 parts by mass, and further preferably 2.0 parts by mass or more and 4.0 parts by mass or less, with respect to 1 part by mass of the leuco dye.

—Hysteresis Temperature Control Agent—

The first composition may contain a hysteresis temperature control agent. The hysteresis temperature control agent is a substance that brings about hysteresis characteristics in the coloration of the leuco dye and the developer. Examples of such a hysteresis temperature control agent include alcohols with a carbon number of 10 or more, esters with a carbon number of 10 or more, ethers with a carbon number of 10 or more, ketones with a carbon number of 10 or more, and the like. Among these, esters described above are desirable.

Among them, as the hysteresis temperature control agent, the esters shown by the following General Formula (1) are desirable as above. The esters shown by the following General Formula (1) are ester compounds composed of 4,4'-(hexafluoroisopropylidene)bisphenol, and saturated or unsaturated fatty acid with a carbon number of 9 to 19.

[Chemical Formula 3]

General Formula (1)

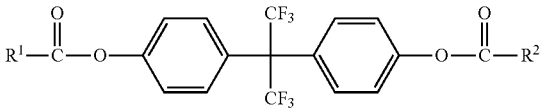

In the above formula, $R^1$ and $R^2$ represent an alkyl group or alkenyl group with a carbon number of 1 or more and 18 or less independently, respectively. The alkyl group or the alkenyl group may branch, and $R^1$ and $R^2$ may be the same group or may be different groups, respectively.

Specific examples of the esters expressed by the above General Formula (1) include 4,4'-(hexafluoroisopropylidene) bisphenol dicaprylate, 4,4'-(hexafluoroisopropylidene) bisphenol dilaurate, 4,4'-(hexafluoroisopropylidene)bisphenol dimiyristate, 4,4'-(hexafluoroisopropylidene)bisphenol dipalmiate, 4,'4-(hexafluoroisopropylidene)bisphenol diundecanoate, 4,4'-(hexafluoroisopropylidene)bisphenol ditridecanoate, and the like.

Although the additive amount of this hysteresis temperature control agent is particularly limited, it is desirable to use the control agent within a range of 1 part by mass or more and 10 parts by mass or less with respect to 1 part by mass of the leuco dye. In addition, the hysteresis temperature control agents may be used singly or may be used in combinations of two or more kinds thereof.

(Second Composition)

The second composition containing a colorable compound having an electron-donative group, a developer having an electron-receptive group, and a decoloring agent having an electron-donative group will be described.

—Colorable Compound—

Examples of the colorable compound that constitutes the second composition include electron-donative organic substances such as leuco auramines, diaryl phthalides, polyaryl carbinols, acyl auramines, aryl auramines, Rhodamine B lactams, indolines, spiropyrans, and fluorans.

—Developer—

Examples of the developer that constitutes the second composition include phenols, phenol metal salt, carboxylic acid, carboxylic acid metal salt, benzophenone, sulfonic acid, sulfonic acid salt, phosphoric acid, phosphoric acid metal salt, acidic phosphoric acid ester, acidic phosphorous acid ester metal salt, phosphorous acid, phosphorous acid metal salt, and the like. The developer may be used singly or may be used in combinations of two or more kinds thereof. Examples of the developers that are particularly preferable among the above include, gallic acid ester, 2,3-dihydroxybenzoic acid, dihydroxybenzoate ester, hydroxy acetophenone, hydroxy benzophenone, and biphenol.

—Decoloring Agent—

Copolymer decoloring agents are used as the decoloring agent that constitutes the second composition. The copolymer decoloring agent is a copolymer compound having an electron-donative group capable of adsorbing a developer physically or chemically. Although the electron-donative group is not particularly limited if those having an action that adsorbs a developer physically or chemically are used, a hydroxyl group, an acyl group, an oxo group, a carbonyl group, an oxycarbonyl group, an amino group, an aromatic amino group, or the like are desirable.

When an image forming material containing the copolymer decoloring agent is brought into contact with an erasing solvent or is heated to a temperature higher than a softening point, the developer coupled with the colorable compound is selectively adsorbed on the electron-donative group of the copolymer decoloring agent, and is not able to act with the colorable compound. As a result, the image forming material changes from a color-developed state to a decolored state. Since the concentration of a functional group per unit volume in the copolymer decoloring agent is higher than that of a low-molecular coloring agent, the copolymer decoloring agent efficiently adsorbs a developer, and stably encloses and carries the developer in a polymer chain. Since the copolymer decoloring agent becomes entangled with a matrix agent, the copolymer decoloring agent does not flow out along with the erasing solvent, even when a solvent is brought into contact with an image forming material to erase an image. For this reason, the developer adsorbed on the copolymer decoloring agent may be stably carried, and poor erasing by the flow or partial bleeding of a color-developed dye component is not caused.

A desirable copolymer decoloring agent is selected from the group consisting of polymer compounds having a sugar skeleton, polyamino acid, polymer compounds having a hydroxyl group, polymer compounds having an amino group, polyvinyl acetal, polyacrylonitrile, and copolymers thereof. The average molecular weight of the copolymer decoloring agent is 800 or more, and more preferably 10000 or more. As for the polymer compounds having the sugar skeleton, the average molecular weight corresponds to trisaccharide or more that is equal to or more than 800.

Examples the polymer compounds having a sugar skeleton include starches such as α-starch, β-starch, corn starch, potato starch, and dogtooth violet starch; grain powders composed mainly of starch such as flour, barley flour, rye flour, and rice flour; starch derivatives such as methylated starch, ethylated starch, acetylated starch, and nitrated starch; cellulose; cellulose derivatives such as cellulose acetate, methylated cellulose, ethylated cellulose, and nitrated cellulose; and polysaccharides and its derivatives thereof such as dextrin, dextran, mannan, amylopectin, amylase, xylan, glycogen, inulin, lichenin, chitin, hemicellulose, pectin, plant gum, agarose, carragenine, saponin, and the like.

(Electrophotographic Developer)

The composition when an electrophotographic developer is used as the image forming material will be described. The electrophotographic developer may be a single-component developer using an electrophotographic toner containing a binder resin, an infrared absorbent, and a decolorable composition. Additionally, the electrophotographic developer may be a two-component developer obtained by combining the electrophotographic toner and a carrier. The electrophotographic developer may contain various additives such as a wax and a charging control agent. Materials well-known in the art may be used as the binder resin, the various additives, and the carrier. The electrophotographic developer is produced by production methods well-known in the art such as a kneading and pulverizing method and a wet granulation method.

Examples of the binder resin include polystyrene, styrene-alkyl acrylate copolymers, styrene-alkyl methacrylate copolymers, styrene-acrylonitrile copolymers, styrene-butadiene copolymers, styrene-maleic anhydride copolymer, polyethylene, polypropylene, and the like. As the charging control agent, there are those for positive charging and for negative charging. Examples of the charging control agents for positive charging include quaternary class ammonium-based compounds. Additionally, examples of the charging control agent for negative charging include metal complexes of alkyl salicylic acid, resin-type charging control agents containing a polar group, and the like. Examples of an offset inhibitor include low-molecular-weight polyethylenes, low-molecular-weight polypropylenes, and the like.

In order to improve flowability and powder storage property and improve frictional charging control, transfer performance, and cleaning performance, inorganic particles or organic particles as an external additive may be added to the surface of toner. Examples of the inorganic particles include silica, alumina, titania, calcium carbonate, magnesium carbonate, calcium phosphate, cerium oxide, and the like. Moreover, well-known surface treatment may be performed on the inorganic particles depending on the purpose. Additionally, examples of the organic particles include emulsified polymers, soap-free polymers, and the like having vinylidene fluoride, methylmethacrylate, a styrene methylmethacrylate, or the like as a constituent component.

(Printing Ink)

The composition when printing ink is used as the image forming material will be described. The printing ink may be aqueous ink containing water, a water-soluble organic solvent, an infrared absorbent, and a decolorable composition. Additionally, the printing ink may be oily ink containing an organic solvent, an infrared absorbent, and a decolorable composition. The printing ink may contain various additives such as resin, an antioxidant, and a surfactant. Materials well-known in the art may be used as the organic solvent and the various additives. The printing ink is produced by production methods well-known in the art.

The ink for ink jet printing may be aqueous ink containing water. In order to improve prevention of dryness of ink and permeability thereof, the ink for ink jet printing may further contain a water-soluble organic solvent. Examples of the water includes ion exchanged water, ultrafiltrated water, pure water, and the like. Additionally, examples of the organic solvent include polyhydric alcohols such as ethylene glycol, diethylene glycol, polyethylene glycol, and glycerol; N-alkyl pyrolidones; esters such as ethyl acetate and amyl acetate; lower alcohols such as methanol, ethanol, propanol, and butanol; glycol ethers such as ethylene oxide or propylene oxide adducts of methanol, butanol, and phenol, and the like. One kind or two or more kinds may be used as the organic solvent to be used. The organic solvent is selected in consideration of the solubility or the like of the infrared absorbent and the decolorable composition. The content of the organic solvent is mass % or more and 60 mass % or less.

Additionally, the ink for ink jet printing may contain additives that are known in the art as ink components in order to satisfy various conditions required for a system of an ink jet printer. Examples of the additives include pH adjusters, resistivity adjusters, antioxidants, antiseptic agents, antifungal agents, sequestering agents, and the like. Examples of the pH adjusters include alcoholic amines, ammonium salts, metal hydroxides, and the like. Examples of the resistivity adjusters include organic salts and inorganic salts. Examples of the sequestering agents include chelating agents and the like.

Additionally, the ink for ink jet printing may include water soluble-resin such as polyvinyl alcohol, polyvinyl pyrrolidone, carboxymethylcellulose, styrene-acrylic acid resin, and styrene-maleic resin to such a degree that blockage of an injection nozzle part, a change in ink discharge direction, or the like does not occur.

The other printing ink may be oily ink containing a polymer or an organic solvent. Generally, examples of the polymer include protein, rubber, celluloses, natural resins such as shellac, copal, starch, and rosin, vinyl-based resins, acryl-based resins, styrene-based resins, polyolefin-based resins, thermoplastic resins such as novolak-type phenol resin, thermosetting resins such as resol-type phenol resin urea resin, melamine resin, polyurthane resin, epoxy, and unsaturated polyester, and the like. Examples of the organic solvent include the organic solvents illustrated in the above description of the ink for ink jet printing.

Additionally, the other printing ink may further contain additives such as a plasticizer for improving the flexibility or strength of a printing film, a solvent for adjustment of viscosity or improvement in dryness, a drying agent, a viscosity modifier, a dispersant, and various reaction agents.

<Image Forming Apparatus>

Next, the image forming apparatus related to the present exemplary embodiment will be described. In the present exemplary embodiment, an electrophotographic image forming apparatus that forms a latent image on an image carrying medium, using the above electrophotographic developer (hereinafter referred to as infrared absorption toner"), will be described.

In addition, a case where the image carrying medium is a "sheet" will be described. Accordingly, the image carrying medium 10 is recast as a "sheet 10".

Figure 2:
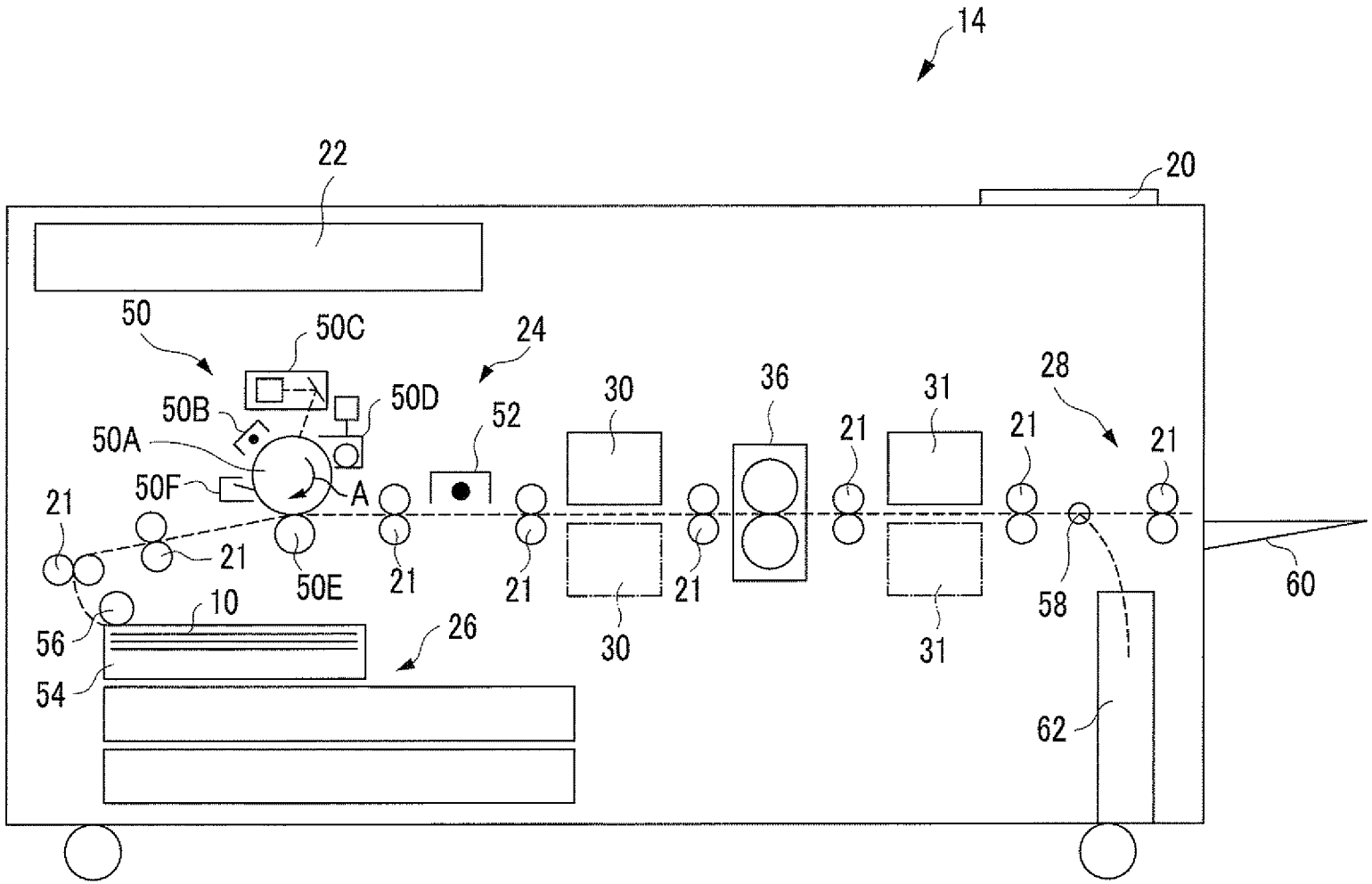
FIG. 2 is a schematic configuration view showing an example of the configuration of an image forming apparatus.
Figure 3:
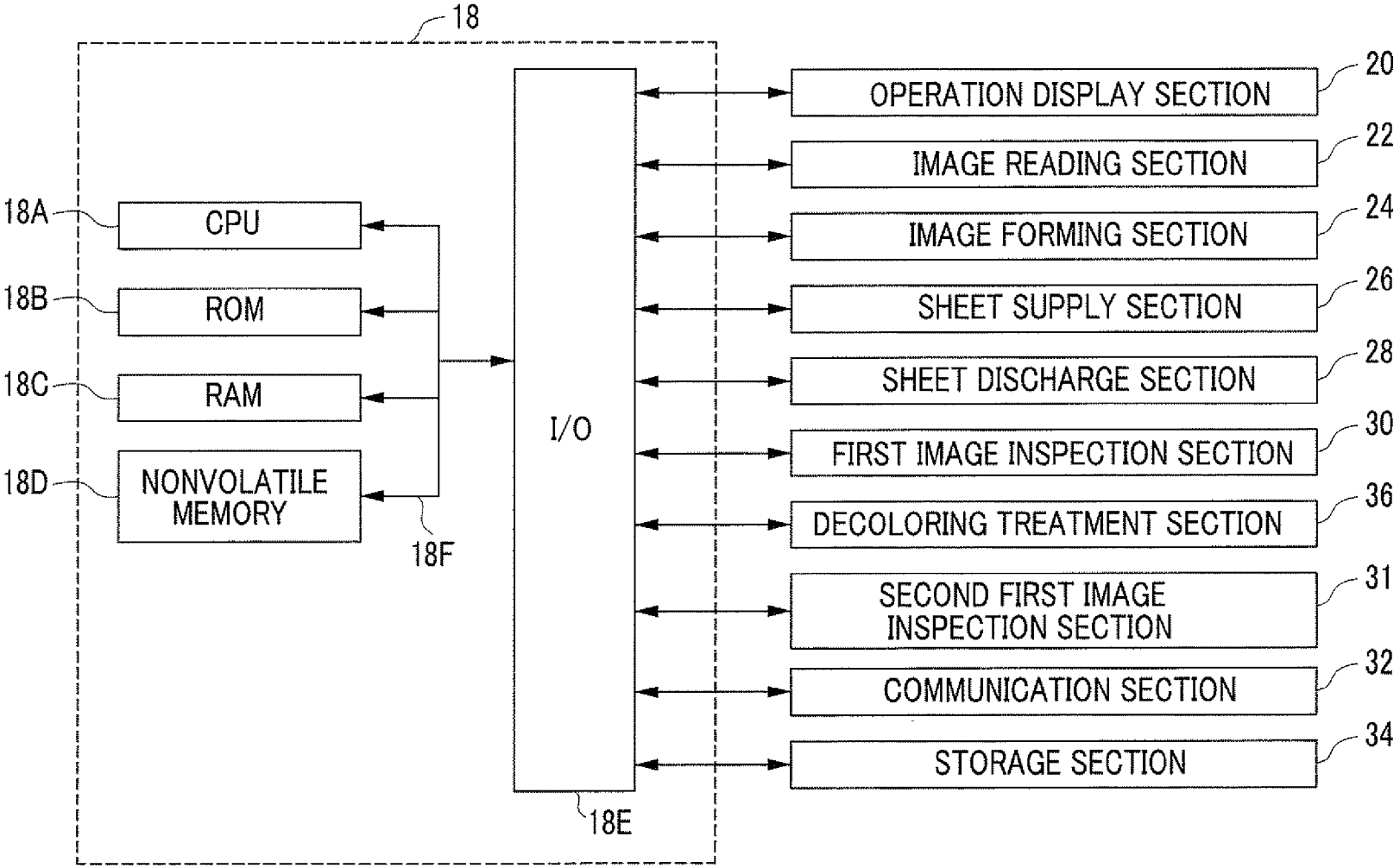
FIG. 3 is a block diagram showing an electrical configuration of the image forming apparatus shown in FIG. 2.

FIG. 2 is a schematic configuration view showing an example of the configuration of the image forming apparatus. FIG. 3 is a block diagram showing an electrical configuration of the image forming apparatus shown in FIG. 2. As shown in FIGS. 2 and 3, an image forming apparatus 14 related to the present exemplary embodiment includes a control section 18, an operation display section 20, an image reading section 22, an image forming section 24, a sheet supply section 26, a sheet discharge section 28, a first image inspection section 30, a decoloring treatment section 36, a second image inspection section 31, a communication section 32, and a storage section 34. The image forming section 24, the sheet supply section 26, the sheet discharge section 28, the first image inspection section 30, the decoloring treatment section 36, and the second image inspection section 31 are arranged in order of the sheet supply section 26, the image forming section 24, the first image inspection section 30, the decoloring treatment section 36, the second image inspection section 31, and the sheet discharge section 28 along a sheet transporting path shown by a dotted line.

The control section 18 is constituted as a computer that performs the control and various calculations of the overall apparatus. That is, the control section 18 includes a CPU (central processing unit) 18A, a ROM (Read Only Memory) 18B that stores various programs, a RAM (Random Access Memory) 18C to be used as a work area when a program is executed, a nonvolatile memory 18D that stores various kinds of information, and an input/output interface (I/O) 18E. The CPU 18A, the ROM 18B, the RAM 18C, and the nonvolatile memory 18D are connected via the I/O 18E via buses 18F, respectively.

Individual sections of the operation display section 20, the image reading section 22, the image forming section 24, the sheet supply section 26, the sheet discharge section 28, the first image inspection section 30, the decoloring treatment section 36, the second image inspection section 31, the communication section 32, and the storage section 34 are connected to the I/O 18E of the control section 18. The control section 18 controls the individual sections of the operation display section 20, the image reading section 22, the image forming section 24, the sheet supply section 26, the sheet discharge section 28, the first image inspection section 30, the decoloring treatment section 36, the second image inspection section 31, the communication section 32, and the storage section 34. In addition, the image forming apparatus 14 has plural transporting rollers 21. The plural transporting rollers 21 are arranged along the sheet transporting path shown by the dotted line. The plural transporting rollers transport a sheet 10 according to an image forming operation.

The operation display section 20 includes a touch panel for displaying various buttons such as a start button and ten keys, various screens such as a settings screen, or the like. Through the above configuration, the operation display section 20 displays various kinds of information to a user while receiving the operation of the user. The image reading section 22 includes an image reader that optically reads an image formed on a sheet such as a CCD image sensor, a scanner for scanning a sheet, or the like. Through the above configuration, the image reading section 22 reads an image of a document sheet placed on the image reading section 22 to generate image information.

The image forming section 24 forms an image on a sheet 10 by electrophotography. The image forming section 24 includes an image forming unit 50 and a fixing device 52. The image forming unit 50 includes a photoconductor drum 50A, a charging device 505, an exposure device 50C, a developing device 50D, a transfer device 50E, a cleaning device 50F, or the like. The photoconductor drum 50A is configured so as to rotate in the direction of an arrow A. The fixing device 52 includes a roller that heats and pressurizes a sheet 10.

The image forming section 24 forms an image, specifically, in the following procedure. The photoconductor drum 50A is charged by the charging device 50B. The exposure device 500 exposes the charged photoconductor drum 50A with the light according to an image. This forms an electrostatic latent image according to an image on the photoconductor drum 50A. The developing device 50D develops the electrostatic latent image formed on the photoconductor drum 50A with toner. The transfer device 50E transfers the toner image formed on the photoconductor drum 50A onto a sheet 10. The fixing device 52 fixes the toner image transferred onto the sheet 10.

In the present exemplary embodiment, an infrared absorption toner is used as the electrophotographic developer. A superimposed image 12 of which a visible image and a latent image are superimposed on each other is formed on a sheet 10 with the infrared absorption toner. In addition, the infrared absorption toner absorbs infrared rays to generate heat. For this reason, the fixing device 52 may be constituted as an optical fixing device including a fixing light source such as a flash lamp, instead of the heating and pressurizing roller.

The sheet supply section 26 includes a sheet accommodating part 54 that accommodates a sheet 10, and a supply mechanism that supplies a sheet 10 to the image forming section 24 from the sheet accommodating part 54. The supply mechanism is constituted by a take-out roller 56 that takes out a sheet 10 from the sheet accommodating part 54, a transporting roller 21, or the like. Plural sheet accommodating parts 54 may be provided according to the type or size of the sheet 10. Through the above configuration, the sheet supply section 26 supplies a sheet 10 to the image forming section 24.

The sheet discharge section 28 includes the discharge part 60 to which a sheet 10 is discharged, a discarding part 62 to which an unnecessary sheet 10 is discarded, a discharge mechanism for discharging a sheet 10 onto the discharge part 60, or the like. The discharge mechanism includes a transporting path switching part 58 that switches the sheet transporting path to the outside of the transporting roller 21 so that the unnecessary sheet 10 may be discarded to the discarding part 62. Through the above configuration, the sheet discharge section 28 decolors the sheet 10 on which the superimposed image 12 is formed, using the decoloring treatment section 36, according to an inspection result obtained by the first image inspection section 30 and discharges the decolored sheet to the discharge part 60 or discards the decolored sheet to the discarding part 62. The sheet 10 to be discarded to the discarding part 62 may be decolored and discarded by the decoloring treatment section 36, or may be discarded without being decolored by the decoloring treatment section 36.

The first image inspection section 30 inspects the image formed on the sheet 10 by the image forming section 24. That is, the first image inspection section 30 reads the image to be inspected that is formed on the sheet 10, to generate "first inspection image information". Accordingly, the first image inspection section 30 includes an image reader that optically reads the image formed on the sheet 10 to generate image information. The specific configuration of the first image inspection section 30 will be described below.

The decoloring treatment section 36 decolors a visible image of which the inspection by the first image inspection section 30 is ended. The superimposed image 12 of which a visible image and a latent image are superimposed on each other is formed on the sheet 10. Therefore, if the visible image is decolored by the decoloring treatment section 36, the image on the sheet 10 becomes a latent image. The decoloring treatment section includes a decoloring unit that causes a decolorable composition contained in an infrared absorption toner to be decolored by physical treatment or chemical treatment. For example, when the infrared absorption toner contains a decolorable composition that is decolored by heating, the decoloring treatment section 36 includes a roller that heats and pressurizes the sheet 10. The specific configuration of the decoloring treatment section 36 will be described below.

The second image inspection section 31 inspects the image on the sheet 10 of which the visible image is decolored by the decoloring treatment section 36. That is, the second image inspection section 31 reads the image to be inspected on the sheet 10 to generate "second inspection image information" after the decoloring treatment. Whether or not the visible image superimposed on the latent image is decolored by the decoloring treatment, that is, the success or failure of the decoloring treatment by the decoloring treatment section 36 is confirmed from the obtained "second inspection image information". The second image inspection section 31 includes an image reader or the like, similarly to like the first image inspection section 30. The specific configuration of the second image inspection section 31 will be described below.

The communication section 32 is an interface for communicating with an external device via a wired or wireless communication line. For example, the communication section 32 functions as an interface for communicating with a computer connected to networks such as a LAN (Local Area Network). The communication section 32 acquires image information such as the "first reference image information" and the "second reference image information" that will be described below, image forming information required for image formation, from external devices such as a computer, by communication.

The storage section 34 includes a storage device such as a hard disk. Various data such as log data, a control program, and the like are stored in the storage section 34. In the present exemplary embodiment, a case where the control program of the image inspection processing to be described below is stored in advance in the storage section 34 will be described. The control program that is stored in advance is read and executed by the CPU 18A.

In addition, various drives may be connected to the control section 18. Various drives are devices that read data from a computer-readable portable recording medium such as a flexible disk, a magneto-optical disc, or CD-ROM, or writes data in the recording medium. When the various drives are provided, the control program may be recorded on the portable recording medium and may be read and executed by a corresponding drive.

Figure 4:
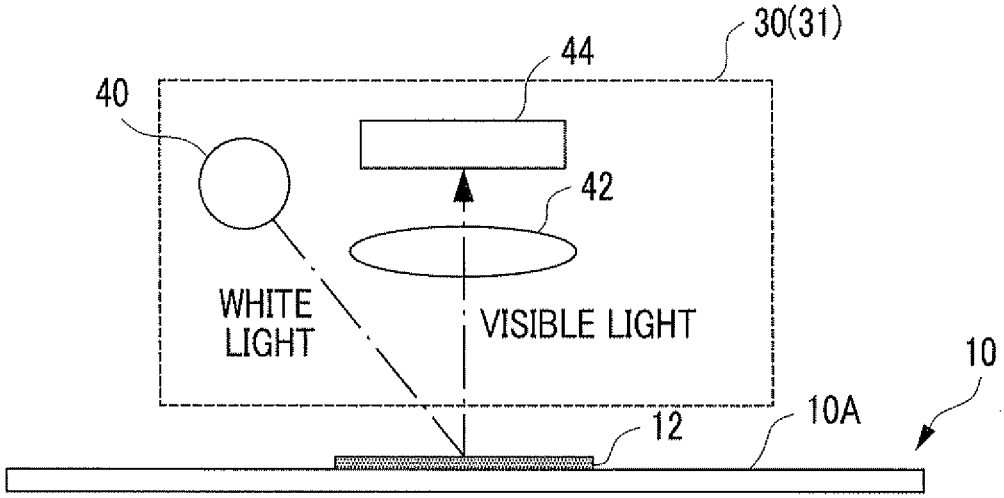
FIG. 4 is a schematic view showing an example of the configuration of an image inspection section.

Here, the configuration of the first image inspection section 30 and the second image inspection section 31 will be specifically described. FIG. 4 is a schematic view showing an example of the configuration of the image inspection section. As shown in FIG. 4, each of the image inspection section 30 and the second image inspection section 31 is arranged so as to face an image forming surface 10A of a supplied sheet 10. Each of the image inspection section 30 and the second image inspection section 31 includes a white light source 40 that irradiates a sheet 10 with white light, an imaging optical system 42, and an optical image reader 44 such as a CCD image sensor.

In the present exemplary embodiment, the superimposed image 12 of which a visible image and a latent image are superimposed is formed on the sheet 10 with an infrared absorption toner containing a decolorable composition. The superimposed image 12 on the sheet 10 is read as a visible image. Accordingly, the image reader 44 is constituted by an ordinary image sensor that reads the visible image. The imaging optical system 42 is arranged so that the reflected light reflected by the sheet 10 may be imaged on the detecting surface of the image reader 44.

As shown in FIG. 4, when inspection of the latent image is performed by the first image inspection section 30, the white light source 40 is turned on and white light is irradiated to the sheet 10 on which the superimposed image 12 is formed. The visible light reflected by the sheet 10 by the irradiation of the white light is imaged on the detecting surface of the image reader 44. The image reader 44 reads the visible image on the sheet 10 to generate the first inspection image information. Since the visible image and the latent image are superimposed on as above, the latent image is read as a visible image.

Additionally, when inspection of the latent image is performed by the second image inspection section 31, similarly, the white light source 40 is turned on and white light is irradiated to the sheet 10 after the decoloring treatment. The light reflected by the sheet 10 by the irradiation of the white light is imaged on the detecting surface of the image reader 44. The image reader 44 reads the image on the sheet 10 after the decoloring treatment to generate the second inspection image information.

Figure 5:
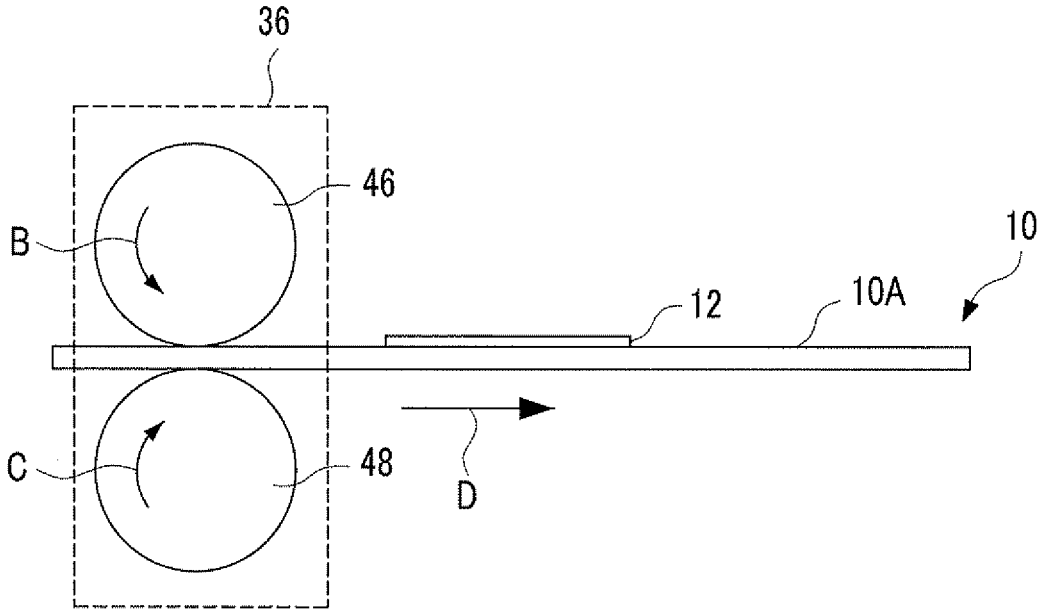
FIG. 5 is a schematic view showing an example of the configuration of a decoloring treatment section.

Next, the configuration of the decoloring treatment section 36 will be specifically described. FIG. 5 is a schematic view showing an example of the configuration of the decoloring treatment section. As shown in FIG. 5, the decoloring treatment section 36 includes a heating roller that rotates in the direction of an arrow B, and a pressure roller 48 that is arranged to face the heating roller 46 and rotates in the direction of an arrow C. The heating roller 46 is, for example, a roller including a heater such as a halogen lamp, inside a highly thermally conductive metallic core.

The sheet 10 on which the superimposed image 12 is formed is supplied to the decoloring treatment section 36 so that the image forming surface 10A may contact the heating roller 46. The sheet 10 on which the superimposed image 12 is formed is nipped between the heating roller 46 and the pressure roller 48 and is transported in the direction of an arrow D. Thereby, the superimposed image formed on the sheet 10 heated and decolored, and the superimposed image 12 becomes a latent image.

As described above, in the image forming apparatus related to the present exemplary embodiment, the superimposed image 12 of which a visible image and a latent image are superimposed on each other is formed by the image forming section 24, and the superimposed image 12 is read as a visible image by the image reader 44 for a visible image of the first image inspection section 30. Thereby, the inspection of the latent image is performed. Additionally, in the image forming apparatus 14 related to the present exemplary embodiment, after the inspection is performed in the first image inspection section 30, the superimposed image 12 is decolored in the decoloring treatment section 36, and becomes a latent image. Moreover, in the image forming apparatus 14 related to the present exemplary embodiment, after the decoloring is performed by the decoloring treatment section 36, the image after the decoloring is inspected in the second image inspection section 31, and the success or failure of the decoloring treatment is confirmed.

In addition, the configuration of the above image forming apparatus is an example, unnecessary functional sections (parts) may be eliminated, new functional sections (parts) may be added, or the configuration and arrangement of the respective sections (parts), may be changed. For example, although the case where the image forming section 24 includes the single image forming unit that forms a superimposed image with an infrared absorption toner has been described in the above, the image forming section 24 may include plural image forming units 50. In the following, the image forming unit 50 that forms an infrared absorption toner image is referred to as an "image forming unit 50IR".

The image forming section 24 may include an image forming unit 50K that forms a black toner image, in addition to the image forming unit 50IR. A black-and-white image is formed on a sheet 10 by the image forming unit 50K. Additionally, in addition to the image forming unit 50IR, the image forming section 24 may include an image forming unit 50Y that forms a yellow toner image, an image forming unit 50M that forms a magenta toner image, an image forming unit 50C that forms a cyan toner image, and an image forming unit 50K that forms a black toner image. Corresponding color images are formed on the sheet 10 top by the image forming units 50Y, 50M, 50C, and 50K, respectively. Additionally, when a configuration in which individual color images are superimposed on each other using an intermediater transfer body or the like, a multicolor image is formed on a sheet 10.

The visible image formed on the sheet 10 in addition to superimposed image 12 may be inspected in the first image inspection section 30. It is noted that the visible image other than the superimposed image is not decolored. For example, plural modes such as a latent image inspection mode and a visible image inspection mode, may be prepared, and image formation, image inspection, or decoloring treatment may be performed according to the mode setting by an operator.

In the latent image inspection mode, after the superimposed image 12 is formed on a sheet 10, and an image to be inspected is read in the first image inspection section 30, the superimposed image is decolored in the decoloring treatment section 36. Additionally, after the superimposed image 12 on the sheet 10 is decolored in the decoloring treatment section 36, an image (image after the decoloring) to be inspected is read in the second image inspection section 31. On the other hand, in the visible image inspection mode, a visible image is formed on the sheet 10, an image to be inspected is read in the first image inspection section 30, and the sheet 10 on which the visible image is formed is discharged to the discharge part 60 as it is.

Additionally, although the case where the decoloring treatment section 36 is arranged on the upstream side of the transporting path switching part 58 has been described in the above, the decoloring treatment section 36 may be arranged between the transporting path switching part 58 and the discharge part 60. In this case, the decoloring treatment is performed on the sheet 10 to be discharged to the discharge part 60.

<Image Inspection Processing>

Next, the "image inspection processing" to be carried out in the image forming apparatus 14 will be described. The control program of the image inspection processing related to the present exemplary embodiment is executed by the CPU 18A of the control section 18. In the following, a case where the latent image inspection mode is set, and the latent image 12 is formed on a sheet 10 by the image forming apparatus 14, and is inspected will be described.

First, the outline of the image inspection processing will be described. In the image inspection processing, the goodness or badness of an image to be inspected is determined on the basis of a predetermined reference image. Additionally, the processing according to the goodness or badness of the image to be inspected may be performed without stopping at the determination of the goodness or badness.

In this processing, a "first reference image" is an image prepared in order to form a predetermined superimposed image 12 on a sheet 10. The superimposed image 12 and the latent image are images to be formed on the basis of the same reference image. The image information on the first reference image is "first reference image information". Additionally, a "first image to be inspected" is an image that is inspected after the superimposed image 12 is formed on a sheet 10 by the image forming apparatus 14. The image information on the image to be inspected is the "first inspection image information".

Additionally, in this processing, a "second reference image" is an image prepared in order to confirm that the superimposed image 12 on a sheet 10 is decolored. The image information on the second reference image is "second reference image information". Additionally, a "second image to be inspected" is an image that is inspected after the superimposed image 12 on a sheet 10 is decolored by the decoloring treatment section 36. The image information on the image to be inspected is the "second inspection image information".

In the following description, when the "first reference image" and the "second reference image" do not need to be distinguished, these images are generically referred to as a "reference image". Additionally, when the "first image to be inspected" and the "second image to be inspected" do not need to be distinguished, these images are generically referred to as an "image to be inspected".

When the image to be inspected and the reference image are compared with each other, and the difference between both the images is equal to or less than a threshold, the image to be inspected is determined to be a superior image, and when the difference between both the images exceeds a threshold, the image to be inspected is determined to be a defective image. For example, when the difference between the reference image information and the inspection image information is calculated, and the calculated difference is equal to or less than a threshold, the image to be inspected is determined to be a superior image, and when the calculated difference exceeds a threshold, the image to be inspected is determined to be a defective image. By comparing the reference image information with inspection image information for each corresponding pixel, the difference between the reference image information and the inspection image information is calculated. When both the images are binary images, the pixel value of each pixel is "0" or "1". Accordingly, the difference between both images is calculated according to the number of pixels having different pixel values.

In the present exemplary embodiment, as shown in FIG. 1A, a binary image prepared in order to form an F-shaped superimposed image 12 on a sheet 10 is regarded as the "first reference image". Additionally, a binary image in a case where the F-shaped superimposed image 12 is not formed on a sheet 10 is regarded as the "second reference image". For example, when another visible image is formed in addition to a latent image, the "second reference image" becomes the other visible image, and when only a latent image is formed, the "second reference image" becomes a blank sheet image (non-image) that does not have a visible image. The F-shaped superimposed image 12 is constituted by the first region 12A, the second region 12B, and the third region 12C.

Figure 6A:
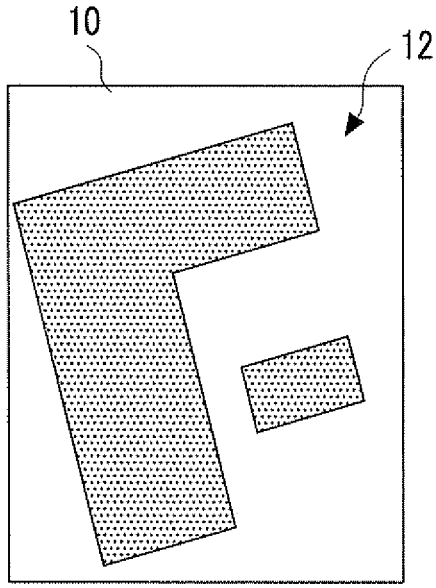
FIGS. 6A and 6B are schematic views showing an example of a defective image.
Figure 6B:
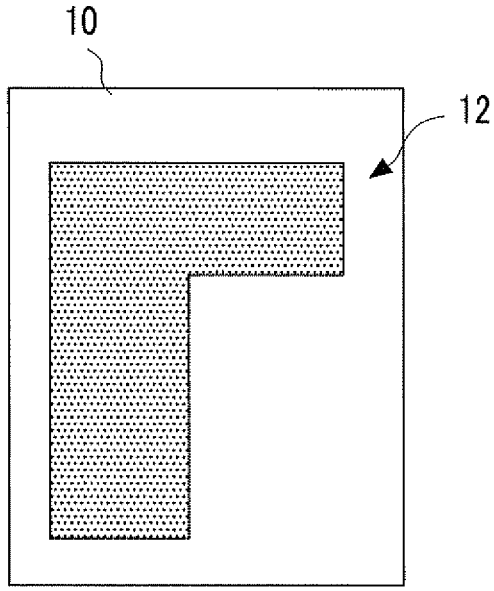

For example, when inspection of a latent image is performed in the first image inspection section 30, as shown in FIG. 6A, the first image to be inspected that is formed at a position where the superimposed image 12 is different from the first reference image such that the F-shaped superimposed image 12 rotates, is determined to be a defective image. Additionally, as shown in FIG. 6B, the first image to be inspected in which a portion of first reference image is chipped such that third region 12C of the superimposed image 12 is missing is determined to be a defective image.

Additionally when inspection of a latent image is performed in the second image inspection section 31, the second image to be inspected that is formed at a position where a visible image is different from the second reference image such that a portion of the F-shaped superimposed image 12 remains without being decolored is determined to be a defective image.

In addition, although the example in which the first reference image information is compared with the first image information to be inspected, the second reference image information is compared with the second image information to be inspected, an image to be inspected is determined with a superior image when the difference between both the compared images is equal to or less than a threshold, and the image to be inspected is determined to be a defective image when the difference between both the images exceeds a threshold has been described in the present exemplary embodiment, the determination criterion is not necessarily limited to this. The determination criterion may be set so that the goodness or badness of an image to be inspected may be determined with high precision.

For example, when inspection of an image after decoloring is inspected in the second image inspection section 31 to confirm the success or failure of the decoloring treatment, the "first reference image information" and the "second image information to be inspected" may be compared with each other without preparing the "second reference image". Otherwise, the "first inspection image information" and the "second image information to be inspected" that are obtained in the first image inspection section 30 may be compared with each other without preparing the "second reference image". When these kinds of information are compared with each other, and the difference between both the images exceeds a threshold, an image to be inspected is determined to be a superior image favorably subjected to decoloring treatment, and when the difference between both images is equal to or less than a threshold, the image to be inspected to is determined to be a defective image subjected to imperfect decoloring treatment.

Figure 7:
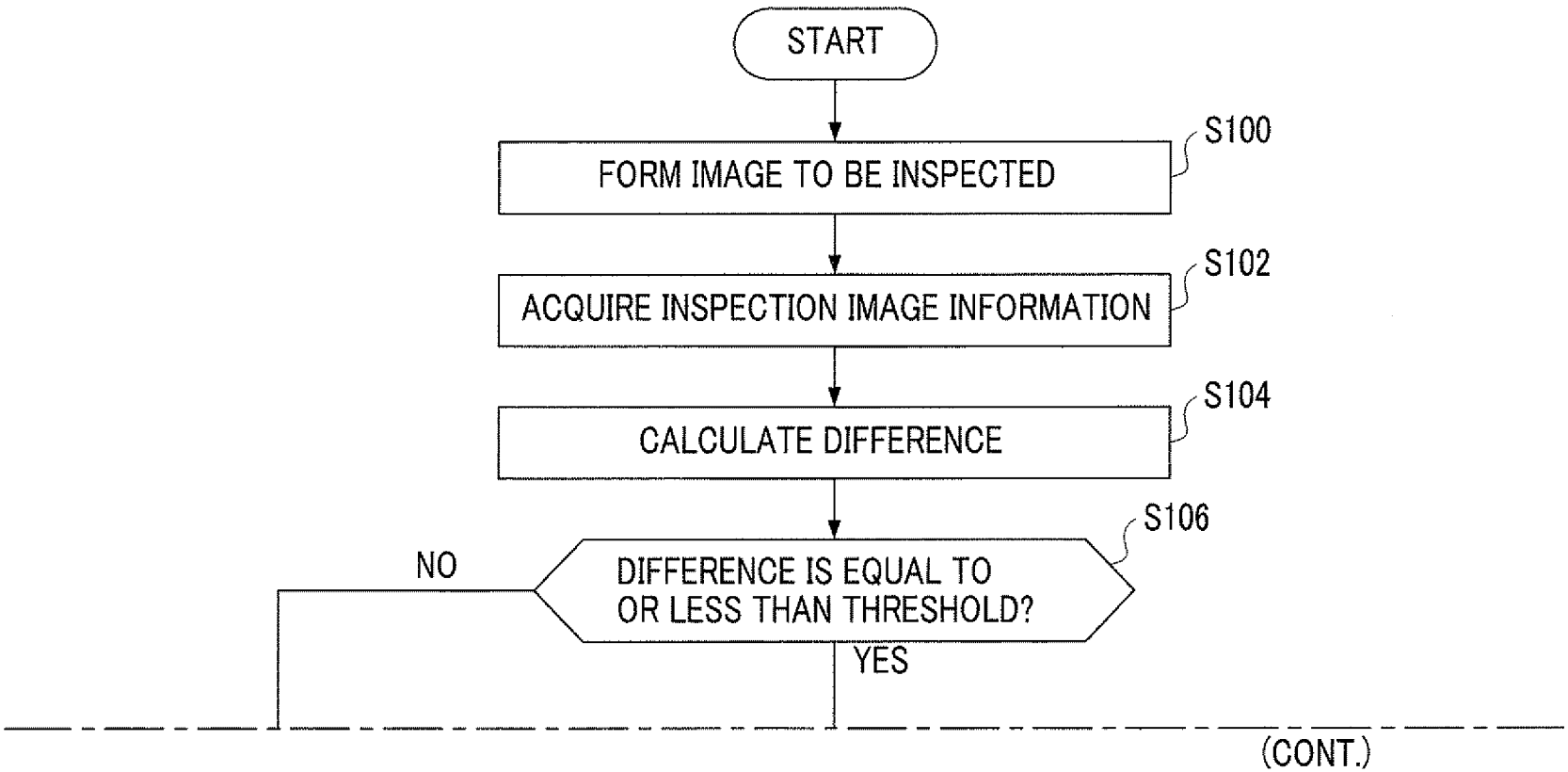
FIG. 7 is a flowchart showing a processing routine of the image inspection processing to be executed in the image forming apparatus.

FIG. 7 is a flowchart showing a processing routine of the image inspection processing. This processing is started when the image information and image forming information required for formation and inspection of a latent image are acquired, for example by receiving information via the communication section 32, and the start of image inspection processing of the latent image is instructed, for example, by setting the latent image inspection mode by the operation of the operation display section 20.

First, in Step 100, the acquired image information and image forming information are supplied to the image forming section 24, and the image forming section 24 is instructed so that an image to be inspected may be formed on the basis of the acquired information. In the image forming section 24, the superimposed image 12 is formed on a sheet 10 on the basis of the acquired information.

Next, the first inspection image information is acquired from the first image inspection section 30 in Step 102. In the first image inspection section 30, the white light source 40 is turned on and white light is irradiated to the sheet 10 on which the superimposed image 12 is formed. The image reader 44 reads the superimposed image 12 that is a visible image, to generate the first inspection image information. The generated first inspection image information is output to the control section 18.

Next, the difference between the first reference image information and the first inspection image information is calculated in Step 104. The first inspection image information acquired in Step 102 is subjected to binarizing. The first reference image information is read from the storage section 34. The difference between the first reference image information and the first inspection image information is calculated by comparing the binarized first inspection image information and first reference image information with each other for every pixel.

Next, it is determined in Step 106 whether or not the difference between the first reference image information and the first inspection image information is equal to or less than a threshold. The "threshold" of the difference is preset according to whether the difference between the first image to be inspected and the first reference image is within an allowable range. When the difference is equal to or less than the threshold in Step 106, the answer is determined to be positive and the processing proceeds to Step 108. When the difference exceeds the threshold in Step 106, the answer is determined to be negative and the processing proceeds to Step 112.

In Step 108, the decoloring treatment section 36 is instructed so as to perform decoloring treatment. In the decoloring treatment section 36, the sheet 10 is nipped between the heating roller 46 and the pressure roller 48, the superimposed image 12 formed on the sheet 10 is heated and decolored, and the superimposed image 12 becomes a latent image.

Next, in Step 110, the second inspection image information is acquired from the second image inspection section 31. In the second image inspection section 31, the white light source 40 is turned on and white light is irradiated to the sheet 10 of which the superimposed image 12 is decolored. The image reader 44 reads the image on the sheet 10 after the decoloring treatment to generate the second inspection image information. The generated second inspection image information is output to the control section 18.

Next, it is determined in Step 116 whether or not the difference between the second reference image information and the second inspection image information is equal to or less than a threshold. The "threshold" of the difference is preset according to whether the difference between the second image to be inspected and the second reference image is within an allowable range. When the difference is equal to or less than the threshold in Step 116, the answer is determined to be positive and the processing proceeds to Step 118. When the difference exceeds the threshold in Step 116, the answer is determined to be negative and the processing proceeds to Step 120.

Next, in Step 118, the sheet discharge section 28 is instructed so as to discharge the sheet 10 to the discharge part 60, and the processing routine is ended. In the sheet discharge section 28, the transporting roller 21 is driven, and the sheet 10 on which the latent image is formed is discharged to the discharge part 60.

On the other hand, if the answer is determined to be negative in Step 106 and the processing proceeds to Step 112, the decoloring treatment section 36 is instructed in Step S112 so as to perform decoloring treatment. Subsequently, in Step 114, the sheet discharge section 28 is instructed so as to discard the sheet 10 to the discarding part 62, and the processing routine is ended. In the sheet discharge section 28, the sheet transporting path is switched by the transporting path switching part 58, the transporting roller 21 is driven, and the sheet 10 subjected to the decoloring treatment is discarded to the discarding part 62.

Further, if the answer is determined to be negative in Step 116 and the processing proceeds to Step 120, the sheet discharge section 28 is instructed in Step 120 so as to discard the sheet 10 to the discarding part 62, and the processing routine is ended. In the sheet discharge section 28, the sheet transporting path is switched by the transporting path switching part 58, the transporting roller 21 is driven, and the sheet 10 subjected to the decoloring treatment is discarded to the discarding part 62.

That is, in the present exemplary embodiment, the processing according to the goodness or badness of the image to be inspected is performed without stopping at the determination of the goodness or badness. When the difference is equal to or less than a threshold according to the determination result in Step 106, a sheet 10 on which a superior image is formed is discharged to the discharge part 60 as usual after the decoloring treatment. On the other hand, when the difference exceeds the threshold, a sheet 10 on which a defective image is formed is pulled out after the decoloring treatment, and is discarded to the discarding part 62. Additionally, when the difference is equal to or less than a threshold according to the determination result in Step 116, a sheet favorably subjected to the decoloring treatment is discharged to the discharge part 60 as usual after the image inspection. On the other hand, when the difference exceeds the threshold, a sheet 10 subjected to insufficient decoloring treatment is pulled out after the image inspection, and is discarded to the discarding part 62.

As described above, in the image inspection processing related to the present exemplary embodiment, when the latent image inspection mode is set, the superimposed image 12 that is a visible image is formed as an image to be inspected on a sheet 10, and the image to be inspected is read by the image reader 44 for a visible image of the first image inspection section 30. After the inspection is performed in the first image inspection section 30, the superimposed image 12 is decolored in the decoloring treatment section 36, and becomes a latent image. Here, a sheet 10 on which a superior image is formed is discharged as usual after the decoloring treatment, according to an inspection result by the first image inspection section 30, and a sheet 10 on which a defective image is formed is pulled out and discarded after the decoloring treatment.

Additionally, in the image inspection processing related to the present exemplary embodiment, when the latent image inspection mode is set, after the superimposed image 12 is decolored in the decoloring treatment section 36, an image to be inspected is read from the sheet 10 after the decoloring treatment by the image reader 44 for a visible image of the second image inspection section 31. Here, a sheet 10 favorably subjected to the decoloring treatment is discharged as usual according to an inspection result by the second image inspection section 31, and the sheet 10 subjected to insufficient decoloring treatment is pulled out and discarded.

In addition, although the example in which the goodness or badness of an image to be inspected is determined according to whether or not the difference between a reference image and the image to be inspected is equal to or less than a threshold has been described in the above image inspection processing, the goodness or badness of the image to be inspected may be determined on the basis of a predetermined reference image, and an image inspection technique is not limited to this that the goodness or badness of an image to be inspected should just be determined. For example, the similarity of a reference image and an image to be inspected may be calculated, and the goodness or badness of the image to be inspected may be determined according to whether or not the calculated similarity is equal to or more than a threshold.

The similarity of the reference image and the image to be inspected may be calculated, for example, on the basis of the distance between the amount of characteristic of the reference image and the amount of characteristic of the image to be inspected. The amount of characteristic includes the brightness distribution of an image, the frequency characteristic of an image, the shape of an object, or the like. The distance between feature amounts includes a Euclidean distance or the like. When the similarity of the reference image and the image to be inspected is equal to or more than a threshold, the image is inspected to be determined to be a superior image, and when the similarity of both the images is less than a threshold, the image to be inspected is determined to be a defective image.

Additionally, when coded information such as two-dimensional codes, is embedded in a latent image, the coded information may be decoded, and then the goodness or badness of an image to be inspected may be determined according to whether or not the decoded and obtained information coincides with the information before being coded.

In addition, although the image inspection processing to be performed in the image forming apparatus has been described above as a control program, a hardware configuration including circuits corresponding to the individual steps may be adopted. Additionally, the processing routine of the above control program is an example, unnecessary steps may be eliminated, new steps may be added, or the processing sequence may be switched.

<Modifications>

In addition, although the example in which the first image inspection section 30, the decoloring treatment section 36, and the second image inspection section 31 are included inside the image forming apparatus 14 has been described in the present exemplary embodiment, an image inspection device, which is arranged outside the image forming apparatus 14 and is independent from the image forming apparatus 14, may be adopted. The image inspection device reads an image to be inspected from a sheet 10 on which the superimposed image 12 is formed by the external image forming apparatus, and carries out decoloring treatment on the sheet 10. The image inspection device includes the sheet supply section 26, the first image inspection section 30, the decoloring treatment section 36, and the second image inspection section 31 of the above image forming apparatus 14, the control section 18 that controls these individual sections, and a transporting mechanism that transports a sheet. For example, a configuration in which the image forming section 24 among the individual sections of the image forming apparatus 14 is omitted may be adopted. In this case, the sheet 10 on which the superimposed image 12 is already formed is supplied to the first image inspection section 30 from the sheet supply section 26.

Additionally, although the example in which an image formed on the sheet 10 by the image forming section 24 is inspected has been described in the present exemplary embodiment, an image to be inspected may be read from the sheet 10 on which the superimposed image 12 is formed in advance. For example, the sheet 10 on which the superimposed image 12 is formed in advance is supplied from the sheet supply section 26. The sheet 10 is supplied to the first image inspection section 30 without performing image formation in the image forming section 24. The first image inspection section 30 inspects the image on the supplied sheet 10.

In addition, the superimposed image 12 may be formed on both surfaces of a sheet 10. Accordingly, the first image inspection section 30 may be configured so as to read an image to be inspected from both surfaces of a sheet 10. The same modification as the first image inspection section 30 is also adopted in the second image inspection section 31.

For example, as shown in FIG. 2, the first image inspection sections 30 may be arranged in two places. The first one (shown by a solid line) of the first image inspection sections 30 may be arranged to face one surface of a sheet 10 and the second one (shown by a dotted line) of the first image inspection sections 30 may be arranged to face the other surface of the sheet 10 so that images to be inspected may be read from both surfaces of the sheet 10. In addition, the second one of the first image inspection sections 30 may be arranged so as to read an image from the other surface of the sheet 10, and the position thereof is not necessarily limited to the position shown by the dotted line. When an image to be inspected is compared with a reference image, the upper and lower surfaces of the image to be inspected may be reversed, and the image to be inspected and the reference image that are reversed may be compared with each other.

Otherwise, the first image inspection section 30 may be arranged in one place, and a sheet reversal mechanism (not shown) that reverses the back and front of a sheet 10 is reversed in the sheet transporting path may be added. After an image to be inspected is read from one surface of the sheet 10, the back and front of the sheet 10 may be reversed, and the first image inspection section 30 may be is supplied so that an image to be inspected is read from the other surface of the sheet 10.

Additionally, when the superimposed image 12 is formed on both surfaces of a sheet 10, the decoloring treatment section 36 may be configured so that decoloring treatment may be performed on both surfaces of the sheet 10. For example, although the decoloring treatment section 36 shown in FIG. 5 includes the heating roller 46 and the pressure roller 48, both surfaces of the sheet 10 are heated by changing the pressure roller 48 to a heating roller.

Figure 8:
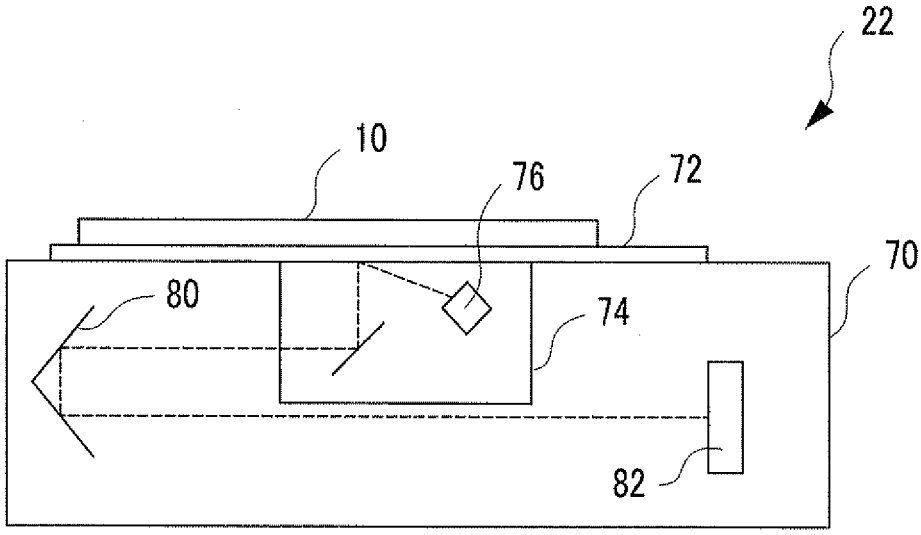
FIG. 8 is a schematic configuration view showing an example of the configuration of an image reading section to which an excitation light source is added.

Additionally, although the example in which an image to be inspected is read in the first image inspection section 30 has been described in the present exemplary embodiment, the image to be inspected may be read in the image reading section 22 when the image to be inspected is read from a sheet 10 on which the superimposed image 12 is formed in advance. An image to be inspected is read similarly to reading the image of a document sheet. FIG. 8 is a schematic configuration drawing showing an example of the configuration of the image reading section 22.

As shown in FIG. 8, the image reading section 22 includes a housing 70, a light transmission part 72 such as a platen glass arranged at an opening portion of the housing 70, a scanning unit 74 that optically scans the sheet 10 placed on the light transmission part 72 while moving, an optical path changing part 80 such as a mirror that changes an optical path of reflected light reflected by the sheet 10, and an optical image reader 82 such as a CCD image sensor. The scanning unit 74 includes a white light source 76 that irradiates the sheet 10 with white light, and an optical-path adjusting mechanism such as a mirror. Additionally, the image reader 82 is constituted by an ordinary image sensor that reads a visible image.

As shown in FIG. 8, when a latent image is inspected, the white light source 76 within the scanning unit 74 is turned on, and the sheet 10 placed on the light transmission part 72 is scanned with white light. The visible light reflected by the sheet 10 by the irradiation of the white light is changed in optical path by the optical path changing part 80, and is imaged on the detecting surface of the image reader 82. The image reader 82 reads the superimposed image 12 that is a visible image, to generate inspection image information. In addition, in this case, in order to obtain a latent image, it is necessary to separately perform decoloring treatment on the sheet 10 on which the superimposed image 12 is formed.

Additionally, although the example in which a sheet 10 on which a superior image is formed is discharged as usual and a sheet 10 on which a defective image is formed is pulled out and discarded has been described in the present exemplary embodiment, an operator may identify the sheet on which a defective image is formed, and the sheet on which a superior image is formed, and the processing according to an inspection result before and after decoloring is not necessarily limited to this.

For example, a sheet 10 on which a defective image is formed before decoloring treatment may be discharged without performing the decoloring treatment. Additionally, a screen showing a sheet 10 on which a defective image is formed may be displayed on the operation display section 20. Additionally, the processing of discharging a sheet 10 on which a defective image is formed while the position thereof is shifted from a sheet 10 on which a superior image is formed, or discharging the sheet while changing the orientation of the sheet, or the like may be performed.

Otherwise, a post-processing device (not shown) may be arranged on the upstream side of the discharge part 60, and the post-processing according to an inspection result before and after decoloring may be performed. For example, a sheet 10 on which a defective image is formed before decoloring treatment may be subjected to the decoloring treatment or may not be subjected to the decoloring treatment. Accordingly, the post-processing device (not shown) may be arranged on the upstream side of the decoloring treatment section 36, or may be arranged on the downstream side of the decoloring treatment section 36.

Figure 9A:
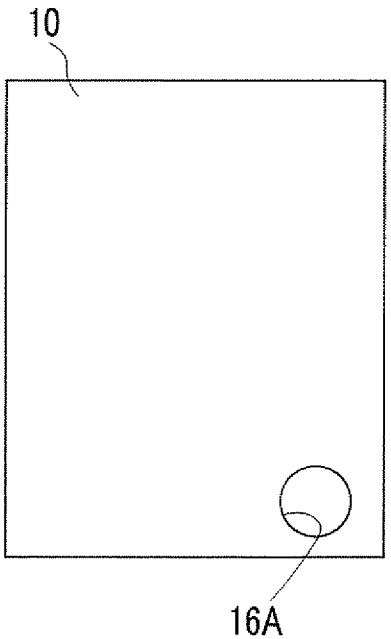
FIGS. 9A to 9C are schematic views showing an example of the processing according to an inspection result.
Figure 9B:
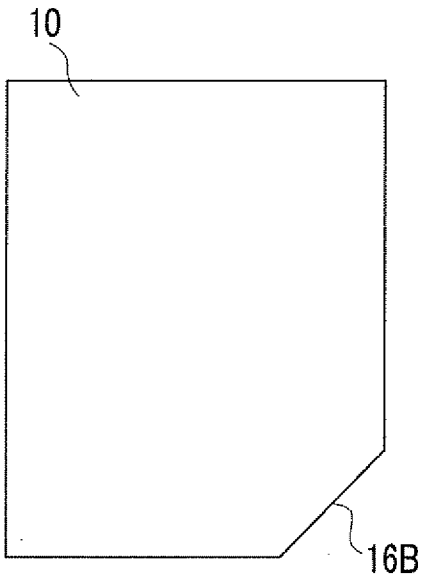
Figure 9C:
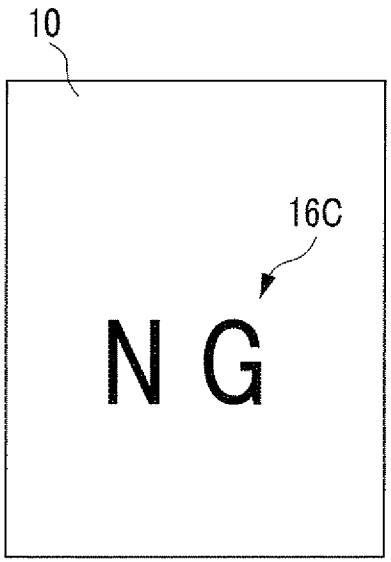

FIGS. 9A to 9C are schematic views showing an example of the processing according to an inspection result. As shown in FIG. 9A, the "punching processing" of forming a through hole 16A in a sheet 10 on that a defective image is formed may be performed. Additionally, as shown in FIG. 9B, the "cutoff processing" of cutting off a portion of a sheet 10 on which a defective image is formed, and forming a cutout 16B may be performed.

Additionally, as shown in FIG. 9C, the "image forming processing" of forming an image 16C indicating being a defective image such that a sheet 10 on which a defective image is formed is stamped may be performed. Additionally, the "attachment processing" of attaching a tag to a sheet 10 on which a defective image is formed may be performed. Such post-processing according to an inspection result may be done by an operator instead of the post-processing device. For example, when an operator is notified of being a sheet 10 on which a defective image is formed by the operation display section 20, the operator may perform the above post-processings.

Additionally, the configuration of the image carrying medium, image forming material, image forming apparatus, and image inspection processing, which has been described in the above exemplary embodiment, is an example, and it is needless to say that the configuration may be changed without departing from the scope of the invention.

<Compounding of Toner> (in the Following "Parts" is Short for "Parts by Mass")

Hysteresis temperature-control agent (4 parts): compound 5: 4,4'-(hexafluoroisopropylidene)bisphenol dilaurate Leuco dye (2 parts): fluoran-based leuco dye (trade name: S-205 made by Yamada Chemical Co., Ltd.)

Absorption peak wavelength of 450 to 590 nm in color-developed state)

Colorable substance (4 parts): 4,4'dihydroxy-3,5'-diallyldiphenylsulfonyl (trade name: TG-SA made by Nippon Kayaku Co., Ltd.)

Binder resin (87.3 parts): polyester resin having bisphenol A alkylene oxide as a constituent component (trade name: FP131 made by Kao Corporation)

Infrared absorbent (2.5 parts): perimidine squarylium dyes expressed by Structural Formula (I)

Release agent (2 parts): polypropylene wax (trade name: 550P made by Sanyo Chemical Industries, Ltd.)

Charging control agent (0.5 parts): quarternary ammonium salt (trade name: PSY made by Clariant (Japan) K.K.)

<Production of Toner>

The above material is mixed, and is melted kneaded (mixed) at 135° C. by an extruder (PCM-30 made by Ikegai Corp.) to produce a kneaded product.

Next, the kneaded product is dipped in liquid nitrogen (−196° C.) for 5 minutes to transfer a leuco dye to a color-developed state, then roughly pulverized by a hammer mill, and finely pulverized by a jet mill. Thereafter, the finely pulverized product is classified by a classifier to obtain respective toner particles of which volume average particle diameter is 4.6 μm.

Fixing

The above toner is used to form an image and perform fixing. The fixing is performed by heating the image for 10 mm seconds at 130° C. by a heating roller.

The decoloring is performed by heating the same image for 40 mm seconds at 120° C. by the heating roller.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image inspection device comprising:

an acquiring section that reads an image formed on an image carrying medium using an image forming material and acquires first inspection image information; and a decoloring section that leaves an infrared absorbent on the image carrying medium, and decolors a decolorable composition on the image carrying medium by physical treatment or chemical treatment, wherein the image forming material contains the infrared absorbent having an optical absorption peak in an infrared region, and the image forming material contains the decolorable composition having an optical absorption peak in a visible region in a color-developed state and being decolored by physical treatment or chemical treatment.

2. The image inspection device according to claim 1, wherein the decoloring section decolors the decolorable composition by heating, light irradiation, or contact with an organic solvent.

3. The image inspection device according claim 1, wherein the infrared absorbent is a naphthalocyanine dye or a perimidine squarylium dye.

4. The image inspection device according to claim 1, wherein the decolorable composition contains a colorable compound having an electron-donative group and a developer having an electron-receptive group.

5. The image inspection device according to claim 4, wherein the decolorable composition further contains a decoloring agent having an electron-donative group.

6. The image inspection device according to claim 1, wherein the colorable compound is a leuco dye.

7. The image inspection device according to claim 1, further comprising:

a comparing section that compares the inspection image information with reference image information; and a processing unit that performs processing according to a comparison result performed by the comparing section.

8. The image inspection device according to claim 1, wherein the image carrying medium is a sheet-shape medium, the acquiring section reads an image from both front and back surfaces of the image carrying medium, and wherein the decoloring section decolors the decolorable composition of both front and back surfaces of the image carrying medium.

9. The image inspection device according to claim 1, wherein the image formed on the image carrying medium includes coded information.

10. The image inspection device according to claim 1, further comprising a second acquiring section that reads the image on the image carrying medium after decoloring, to acquire second inspection image information.

11. The image inspection device according to claim 10, further comprising:

a first comparing section that compares the first inspection image information with first reference image information;

a second comparing section that compares the second inspection image information with second reference image information; and a processing unit that performs processing according to a comparison result performed by the first comparing section and a comparison result by the second comparing section.

12. An image forming apparatus comprising:

an image forming section that forms an image on an image carrying medium, using an image forming material;

an acquiring section that reads the image formed on the image carrying medium by the image forming section and acquires first inspection image information; and a decoloring section that leaves the infrared absorbent on the image carrying medium, and decolors a decolorable composition on the image carrying medium by physical treatment or chemical treatment, wherein the image forming material contains an infrared absorbent having an optical absorption peak in an infrared region, and the image forming material contains the decolorable composition having an optical absorption peak in a visible region in a color-developed state and being decolored by physical treatment or chemical treatment.

13. The image forming apparatus according to claim 12, further comprising a second acquiring section that reads the image on the image carrying medium after decoloring, to acquire second inspection image information.

14. The image forming apparatus according to claim 13, wherein the decoloring section is a decoloring section that decolors the decolorable composition by heating, light irradiation, or contact with an organic solvent.

15. The image forming apparatus according claim 13, wherein the infrared absorbent is a naphthalocyanine-based dye or a perimidine squarylium dye.

16. The image forming apparatus according to claim 13, wherein the decolorable composition contains a colorable compound having an electron-donative group and a developer having an electron-receptive group.

17. The image forming apparatus according to claim 16, wherein the decolorable composition further contains a decoloring agent having an electron-donative group.

18. The image forming apparatus according to claim 13, wherein the colorable compound is a leuco dye.

* * * * *